US010535508B2

(12) United States Patent
Murray et al.

(10) Patent No.: US 10,535,508 B2
(45) Date of Patent: Jan. 14, 2020

(54) DEVICES AND METHODS FOR MAI IONIZATION

(71) Applicant: BOARD OF SUPERVISORS OF LOUISIANA STATE UNIVERSITY AND AGRICULTURAL AND MECHANICAL COLLEGE, Baton Rouge, LA (US)

(72) Inventors: Kermit King Murray, Baton Rouge, LA (US); Bijay Kumar Banstola, Baton Rouge, LA (US)

(73) Assignee: BOARD OF SUPERVISORS OF LOUISIANA STATE UNIVERSITY AND AGRICULTURAL AND MECHANICAL COLLEGE, Baton Rouge, LA (US)

( * ) Notice: Subject to any disclaimer, the term of this patent is extended or adjusted under 35 U.S.C. 154(b) by 0 days.

(21) Appl. No.: 16/204,004

(22) Filed: Nov. 29, 2018

(65) Prior Publication Data

US 2019/0164736 A1 May 30, 2019

Related U.S. Application Data

(60) Provisional application No. 62/592,126, filed on Nov. 29, 2017.

(51) Int. Cl.

| | |
|---|---|
| ***H01J 49/04*** | (2006.01) |
| ***H01J 49/26*** | (2006.01) |
| ***H01J 49/10*** | (2006.01) |

(52) U.S. Cl.

CPC ..... *H01J 49/0454* (2013.01); *H01J 49/10* (2013.01); *H01J 49/26* (2013.01)

(58) Field of Classification Search

CPC ..... H01J 49/0454; H01J 49/10; H01J 49/26
USPC ..... 250/281, 282, 286, 287, 288
See application file for complete search history.

(56) References Cited

PUBLICATIONS

Trimpin S, Lee C, Weidner SM, et al. Unprecedented Ionization Processes in Mass Spectrometry Provide Missing Link between ESI and MALDI. ChemPhysChem 2018; 19: 581-589. doi: 10.1002/cphc.201800144.

Trimpin S, Karki S, Marshall DD, et al. Combining Novel and Traditional Ionization Methods for Mass Spectrometry for More Comprehensive Analyses. LC GC N. Am 2018; 16: 12.

Dreisewerd K. Recent methodological advances in MALDI mass spectrometry. Anal. Bioanal. Chem. 2014; 406: 2261-2278. doi: 10.1007/s00216-014-7646-6.

Musapelo T and Murray KK. Size distributions of ambient shock-generated particles: implications for inlet ionization. Rapid Commun. Mass Spectrom. 2013; 27: 1283-1286. doi: 10.1002/rcm.6568.

Trimpin S and Inutan ED. Matrix assisted ionization in vacuum, a sensitive and widely applicable ionization method for mass spectrometry. J. Am. Soc. Mass. Spectrom. 2013; 24: 722-732. doi: 10.1007/s13361-012-0571-z.

(Continued)

*Primary Examiner* — Nicole M Ippolito
*Assistant Examiner* — Hanway Chang
(74) *Attorney, Agent, or Firm* — Thomas | Horstemeyer, LLP

(57) ABSTRACT

Mass spectrometry systems and methods including ionization devices are provided. The ionization device includes either a gas pulse valve or a piezoelectric striker. The ionization device is configured to direct force to the back of a substrate, where an analyte of interest is deposited on the front of the substrate. The impact ionizes the analyte and the ions are directed into a mass spectrometer for analysis.

18 Claims, 13 Drawing Sheets

(56) References Cited

PUBLICATIONS

McEwen CN, Pagnotti VS, Inutan ED, et al. New paradigm in ionization: multiply charged ion formation from a solid matrix without a laser or voltage. Anal. Chem. 2010; 82: 9164-9168. doi: 10.1021/ac102339y.
Lietz CB, Richards AL, Ren Y, et al. Inlet ionization: protein analyses from the solid state without the use of a voltage or a laser producing up to 67 charges on the 66 kDa BSA protein. Rapid Commun. Mass Spectrom. 2011; 25: 3453-3456. doi: 10.1002/rcm.5233.
Banstola B and Murray KK. Pulsed valve matrix-assisted ionization. Analyst 2017; 142: 1672-1675. doi: 10.1039/c7an00489c.
Banstola B, Grodner ET, Cao F, et al. Systematic assessment of surfactants for matrix-assisted laser desorption/ionization mass spectrometry imaging. Anal. Chim. Acta 2017; 963: 76-82. doi: 10.1016/j.aca.2017.01.054.
Hsu F-F and Turk J. Electrospray ionization/tandem quadrupole mass spectrometric studies on phosphatidylcholines: the fragmentation processes. J. Am. Soc. Mass. Spectrom. 2003; 14: 352-363. doi: 10.1016/S1044-0305(03)00064-3.
Tsui Z-C, Chen Q-R, Thomas MJ, et al. A method for profiling gangliosides in animal tissues using electrospray ionization-tandem mass spectrometry. Anal. Biochem. 2005; 341: 251-258. doi: 10.1016/j.ab.2005.03.036.
Bond MR, Whitman CM and Kohler JJ. Metabolically incorporated photocrosslinking sialic acid covalently captures a ganglioside-protein complex. Mol. Biosyst. 2010; 6: 1796-1799. doi: 10.1039/C0MB00069H.
Richards AL, Lietz CB, Wager-Miller J, et al. Localization and imaging of gangliosides in mouse brain tissue sections by laserspray ionization inlet. J. Lipid Res. 2012. doi: 10.1194/jlr.D019711.
Inutan ED and Trimpin S. Matrix assisted ionization vacuum, a new ionization method for biological materials analysis using mass spectrometry. Mol. Cel. Proteomics 2012: mcp. M112. 023663. doi: 10.1074/mcp.M112.023663.
S. Trimpin, B. Wang, C. B. Lietz, D. D. Marshall, A. L. Richards and E. D. Inutan, Crit. Rev. Biochem. Mol. Biol., 2013, 48, 409-429.
S. Trimpin, J. Am. Soc. Mass Spectrom., 2015, 27, 4-21.
P. M. Peacock, W.-J. Zhang and S. Trimpin, 2017, 89, 372-388.
S. Trimpin, B. Wang, E. D. Inutan, J. Li, C. B. Lietz, A. Harron, V. S. Pagnotti, D. Sardelis and C. N. McEwen, J. Am. Soc. Mass Spectrom., 2012, 23, 1644-1660.
J. Li, E. D. Inutan, B. Wang, C. B. Lietz, D. R. Green, C. D. Manly, A. L. Richards, D. D. Marshall, S. Lingenfelter, Y. Ren and S. Trimpin, J. Am. Soc. Mass Spectrom., 2012, 23: 1625-1643.
V. S. Pagnotti, E. D. Inutan, D. D. Marshall, C. N. McEwen and S. Trimpin, 2011, 83, 7591-7594.
A. L. Richards, C. B. Lietz, J. B. Wager-Miller, K. Mackie and S. Trimpin, Rapid Commun. Mass Spectrom., 2011, 25, 815-820.
V. V. Golovlev, S. L. Allman, W. R. Garrett, N. I. Taranenko and C. H. Chen, Int. J. Mass Spectrom. & Ion Processes, 1997, 169, 69-78.
J. Perez, L. E. Ramirez-Arizmendi, C. J. Petzold, L P. Guler, E. D. Nelson and H. I. Kenttamaa, Int. J. Mass Spectrom., 2000, 198, 173-188.
S.-C. Cheng, T.-L. Cheng, H.-C. Chang and J. Shiea, Anal. Chem. 2009, 81, 868-874.
L. Jia, J. Weng, Z. Zhou, F. Qi, W. Guo, L. Zhao and J. Chen, Rev. Sci. Instrum., 2012, 83(2), 026105.
U. Sezer, L. Wörner, J. Horak, L. Felix, J. Tüxen, C. Götz, A. Vaziri, M. Mayor and M. Arndt, Anal Chem. 2015, 87, 5614-5619.
K. Benham, R. Hodyss, F. M. Fernández and T. M. Orlando, J. Am. Soc. Mass Spectrom., 2016 27(11) 1805-1812.
S. Heron, R. Wilson, S. Shaffer, D. R. Goodlett and J. Cooper, Anal. Chem. 2010, 82(10), 3985-3989.
T. Musapelo and K. K. Murray, J. Am. Soc. Mass Spectrom., 2013, 24, 1108-1115.
J. E. Lingeman, J. A. McAteer, E. Gnessin and A. P. Evan, Nat. Rev. Urol., 2009, 6, 660-670.
P. Lukes, F. Fernández, J. Gutiérrez-Aceves, E. Fernández, U. M. Alvarez, P. Sunka and A. M. Loske, Shock Waves, 2016, 26(1), 1-23.

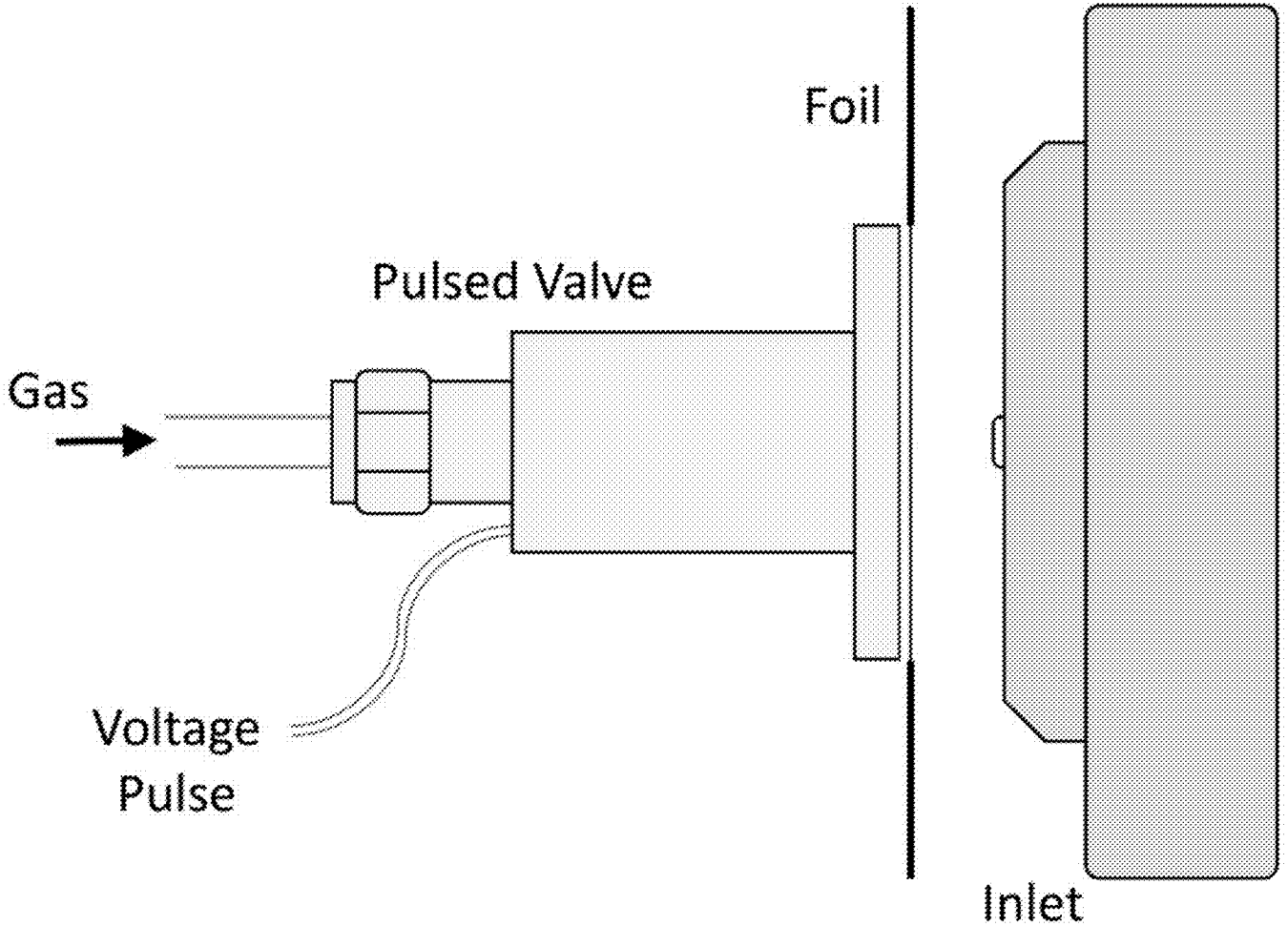
Fig. 1.1

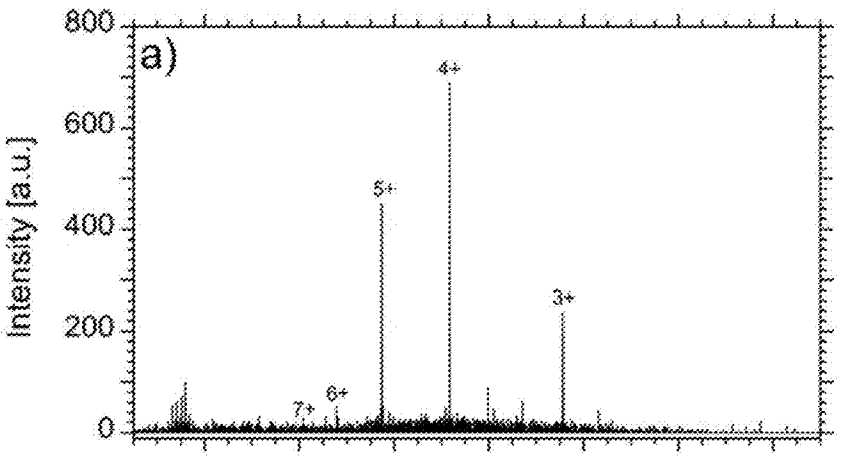
Fig. 1.2A
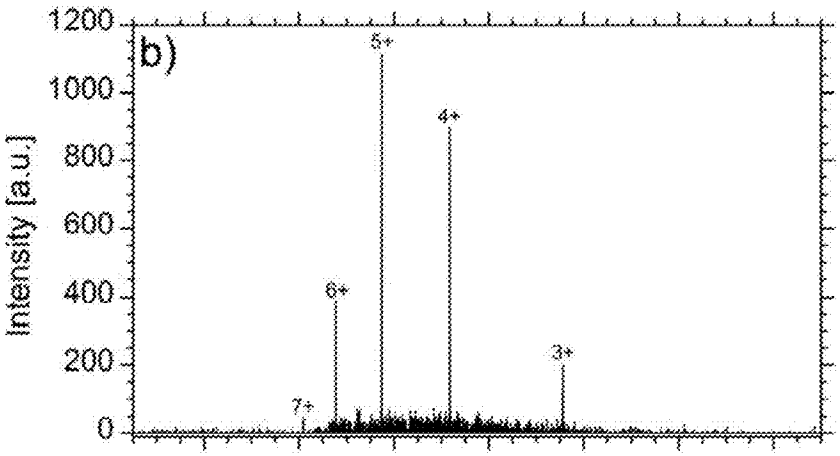
Fig. 1.2B
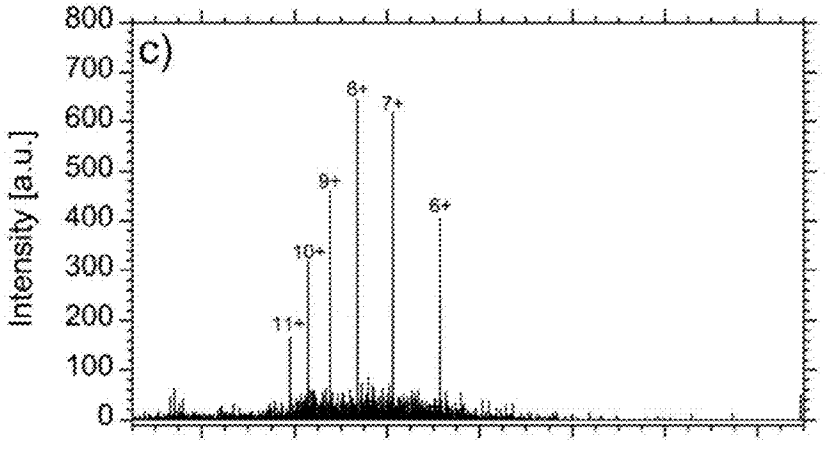
Fig. 1.2C
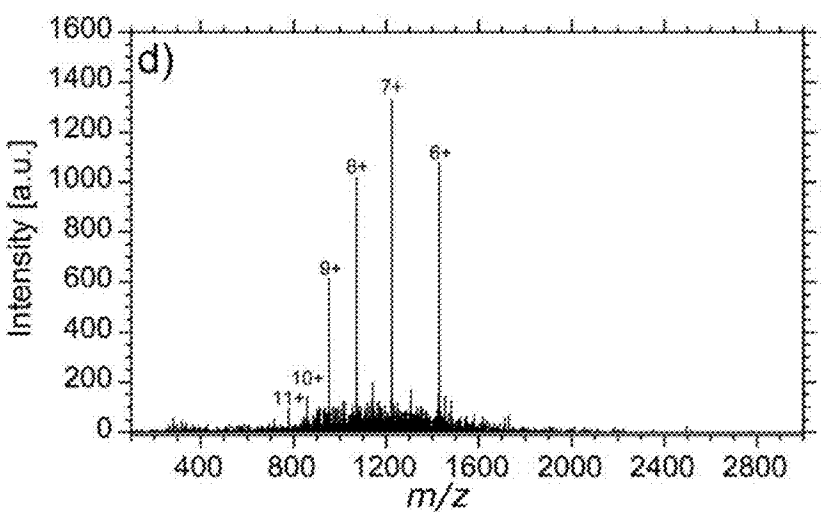
Fig. 1.2D

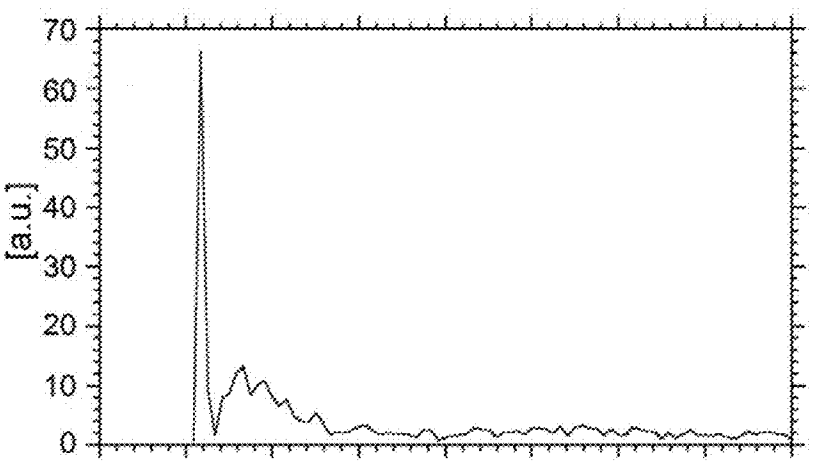
Fig. 1.3A
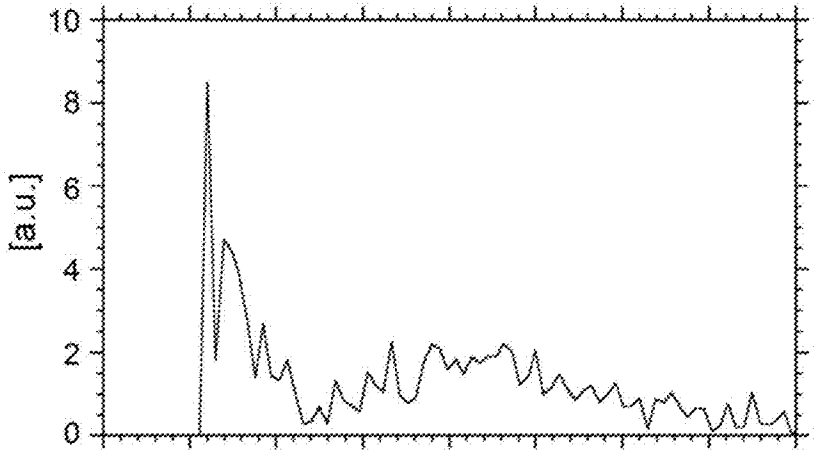
Fig. 1.3B
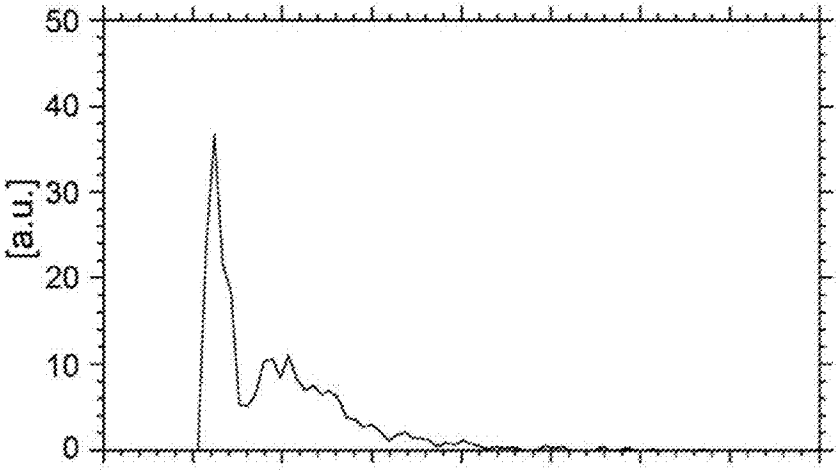
Fig. 1.3C
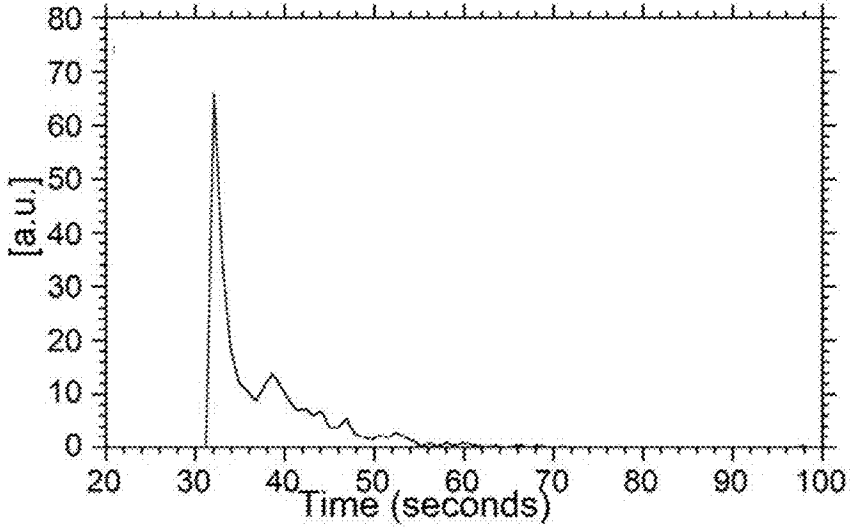
Fig. 1.3D

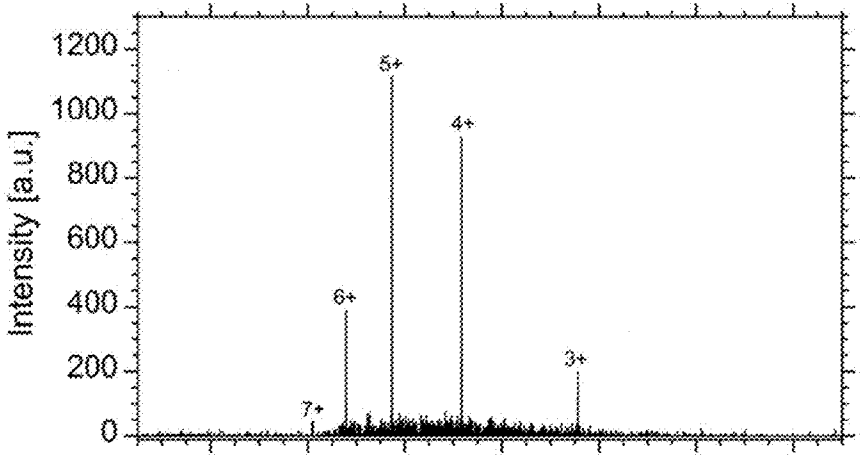
Fig. 1.4A
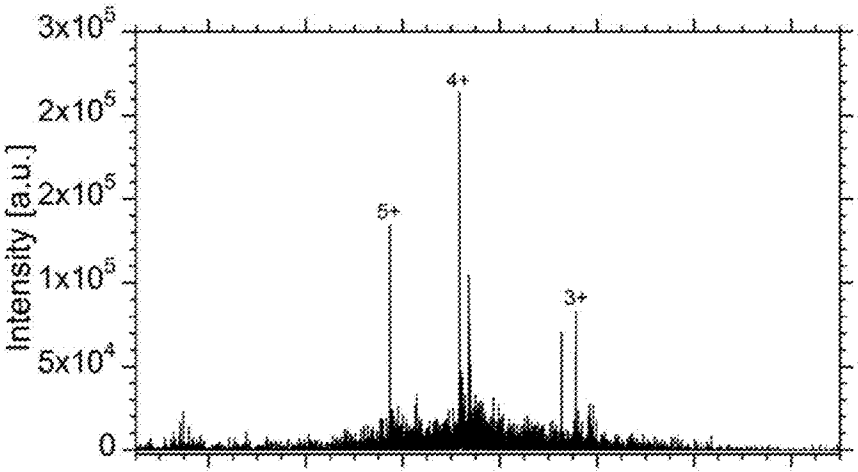
Fig. 1.4B
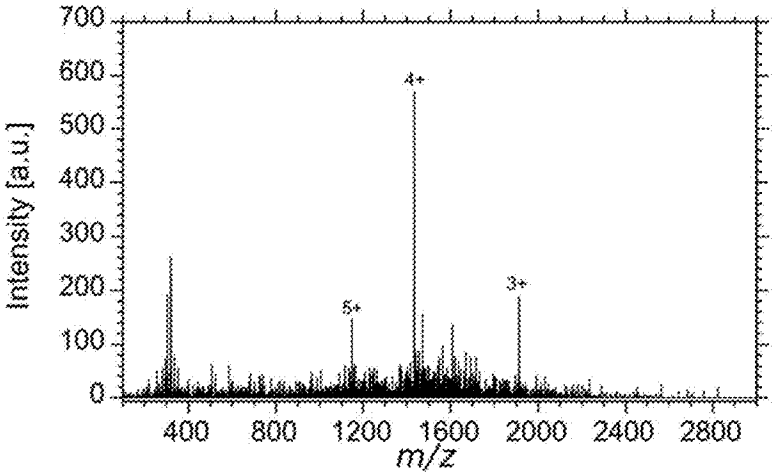
Fig. 1.4C

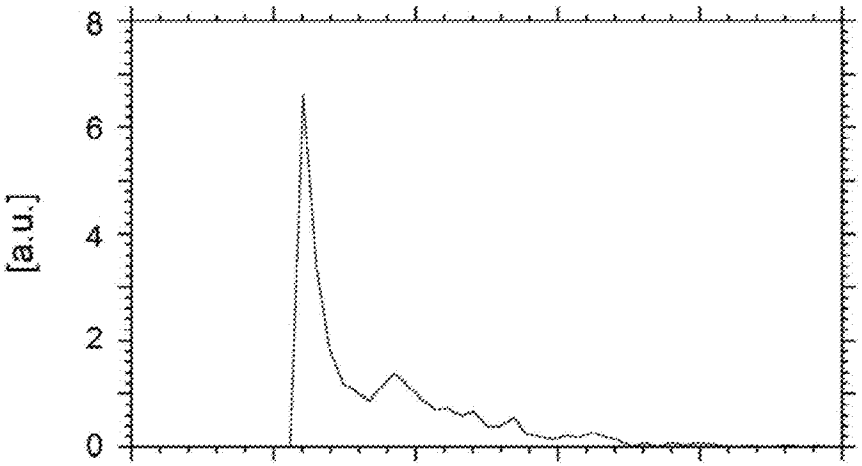
Fig. 1.5A
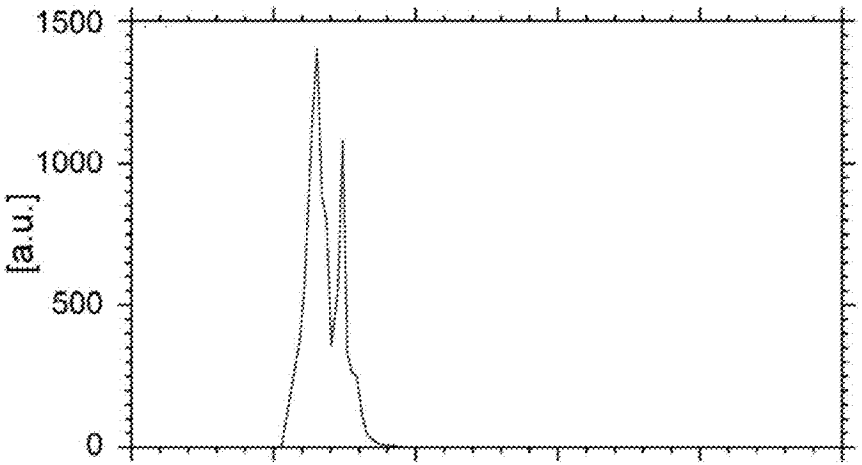
Fig. 1.5B
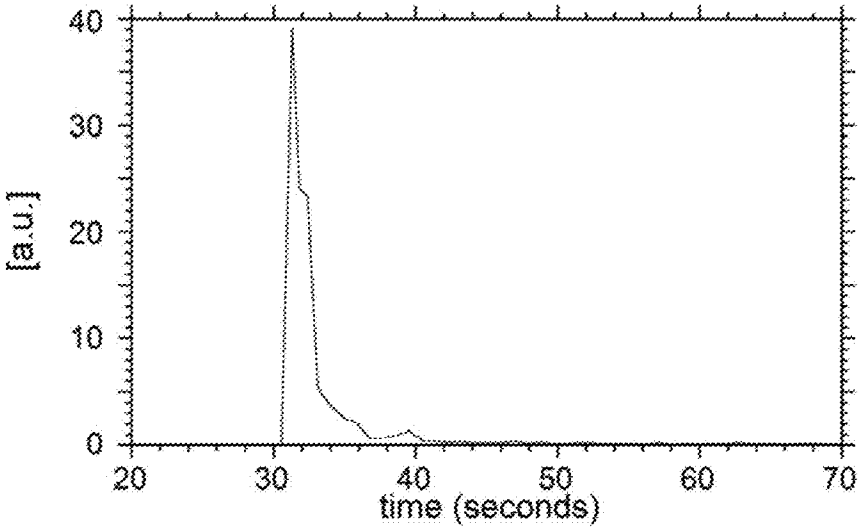
Fig. 1.5C

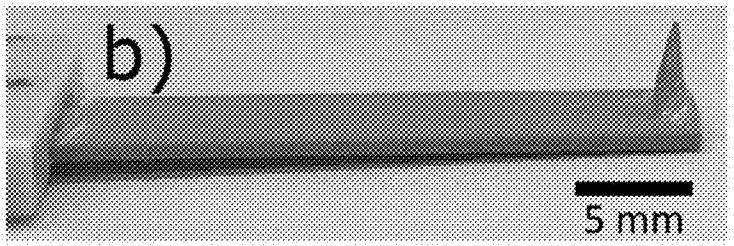
Fig. 2.1B
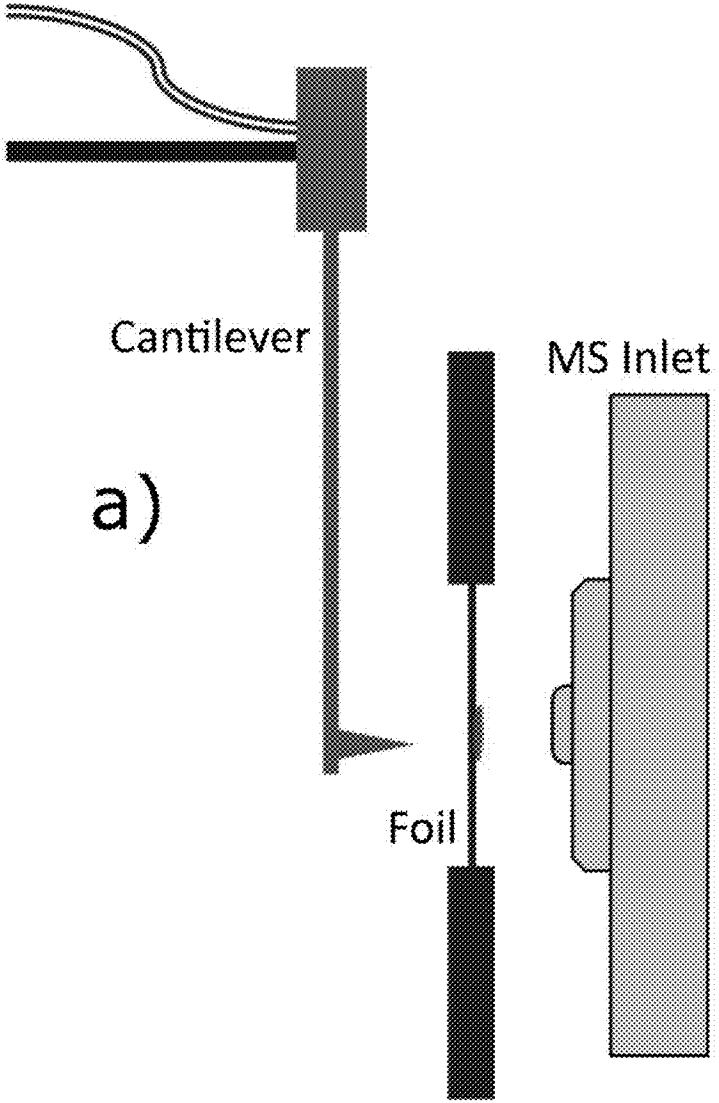
Fig. 2.1A

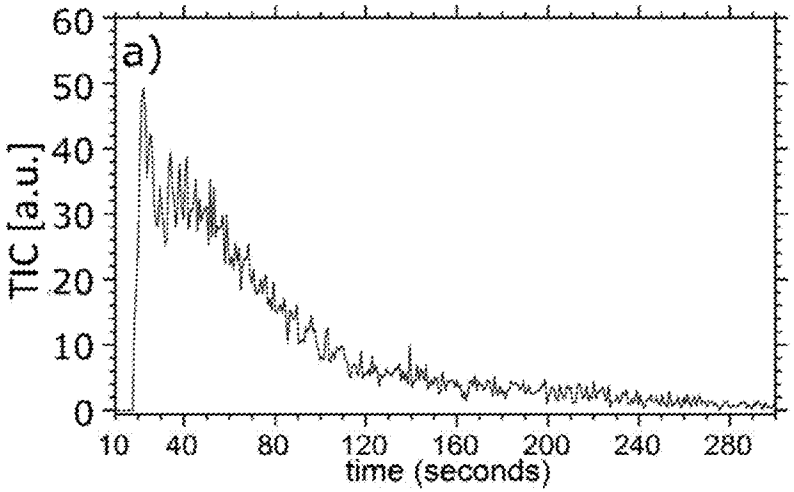
Fig. 2.2A
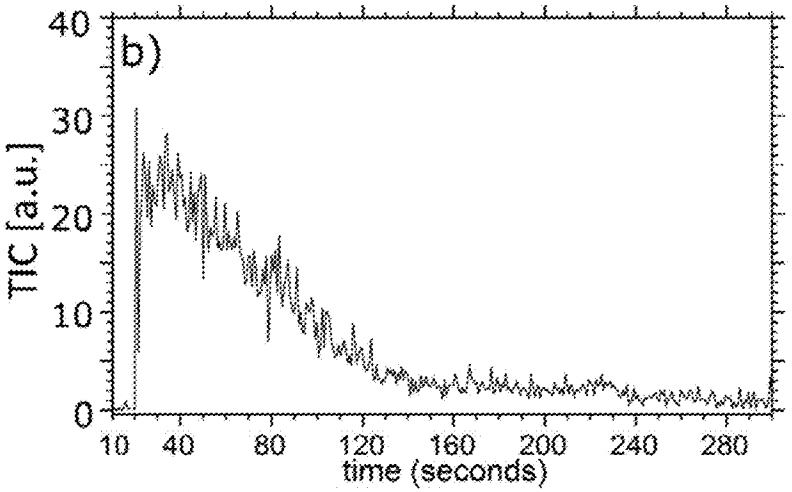
Fig. 2.2B
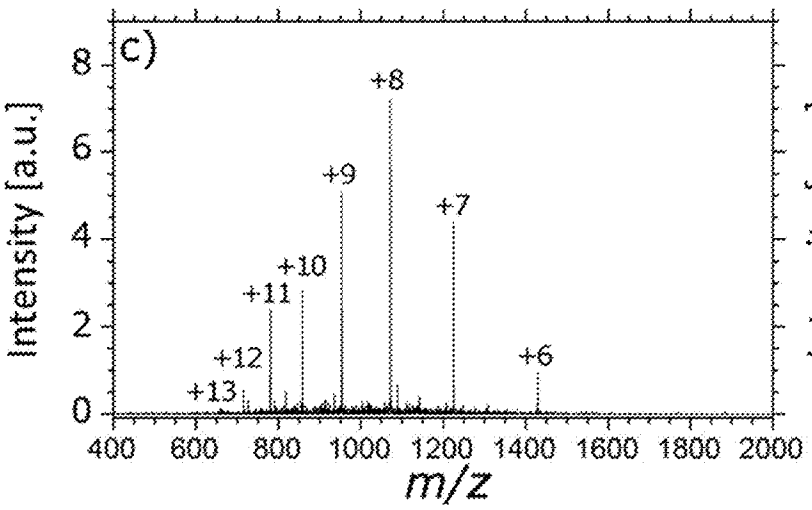
Fig. 2.2C
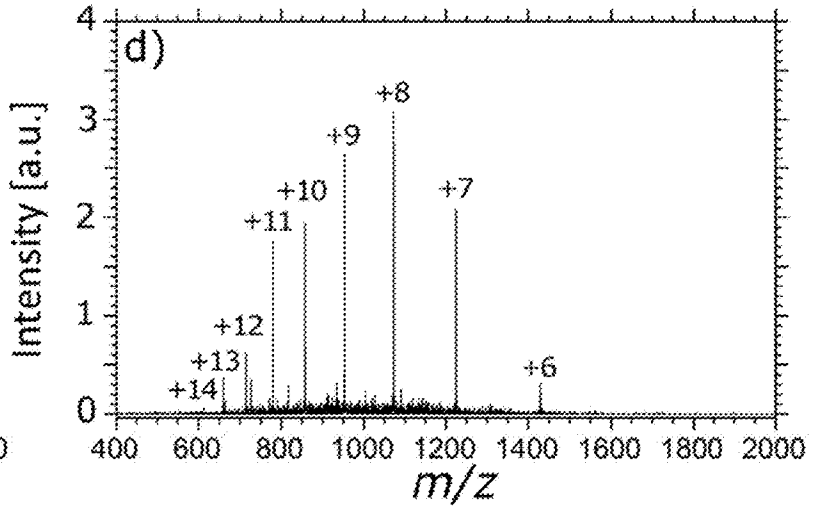
Fig. 2.2D

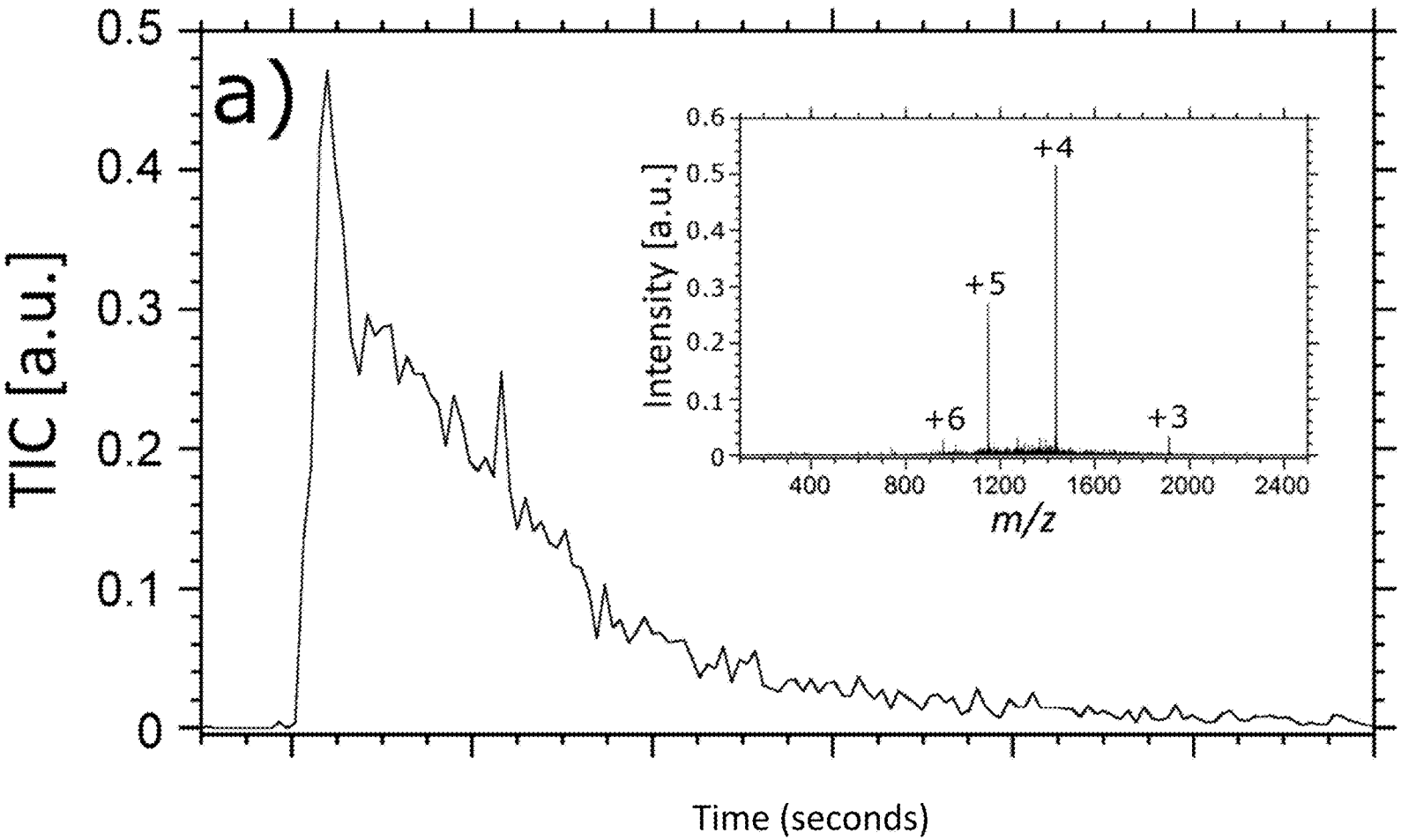
Fig. 2.3A

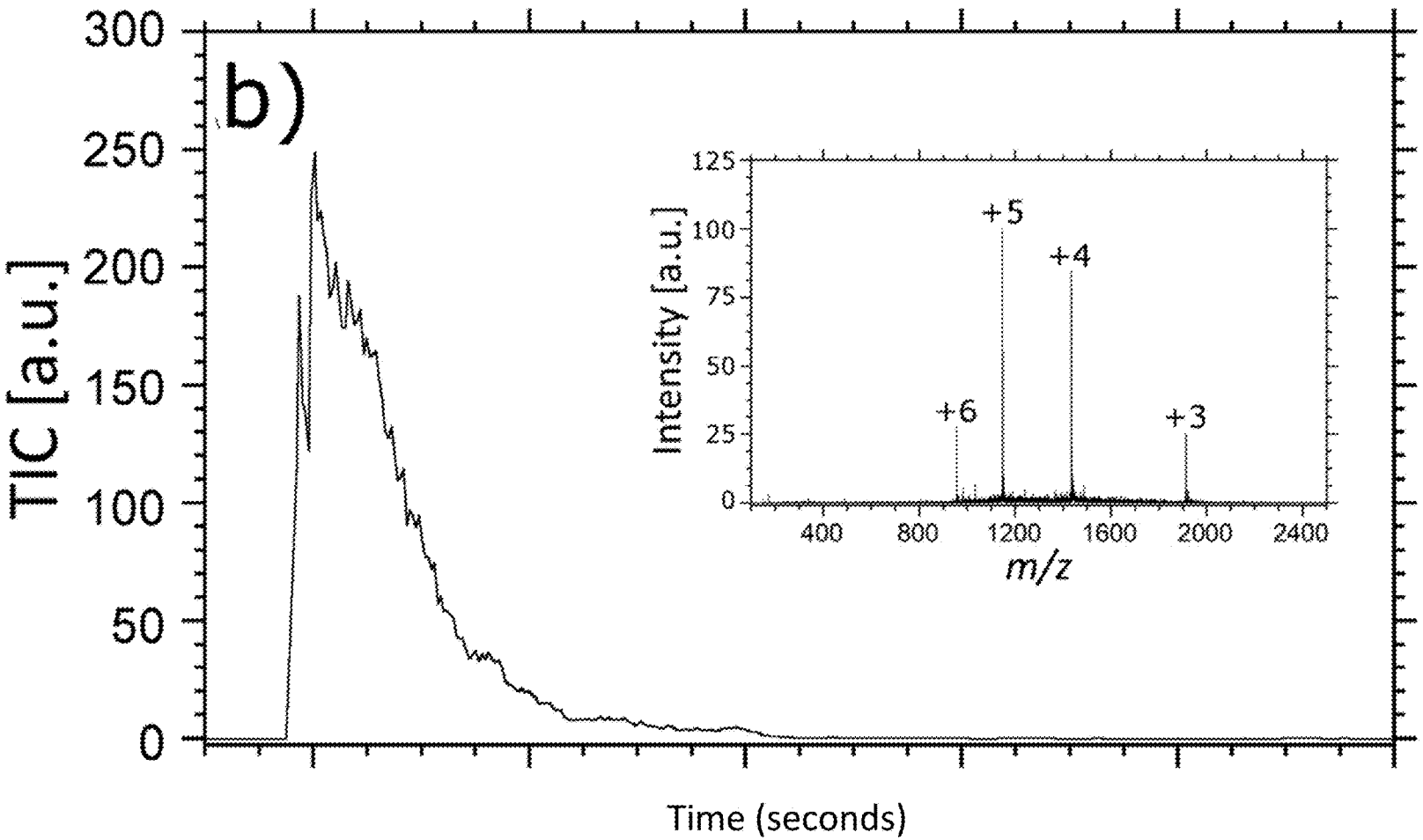
Fig. 2.3B

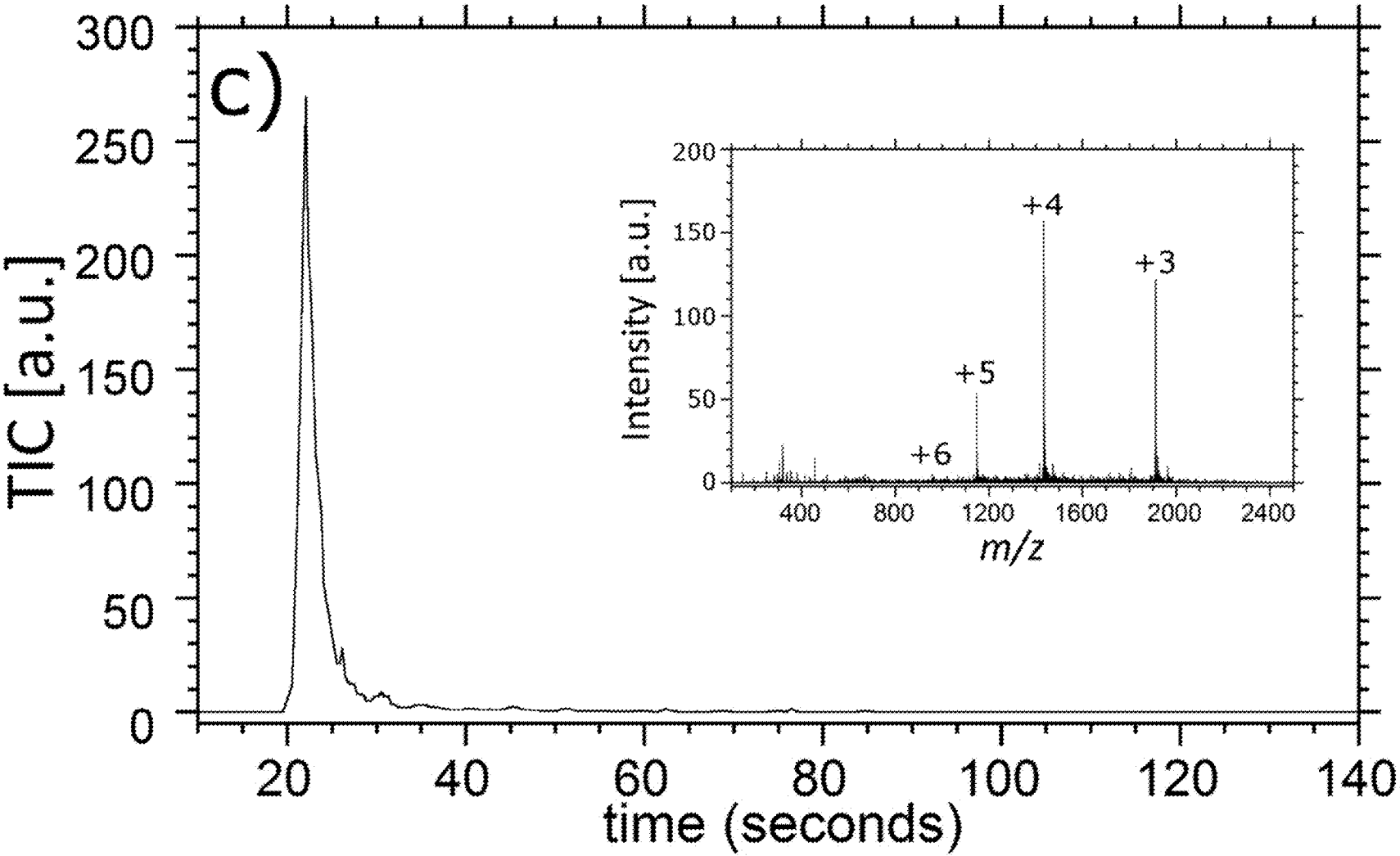
Fig. 2.3C

Fig. 2.4A
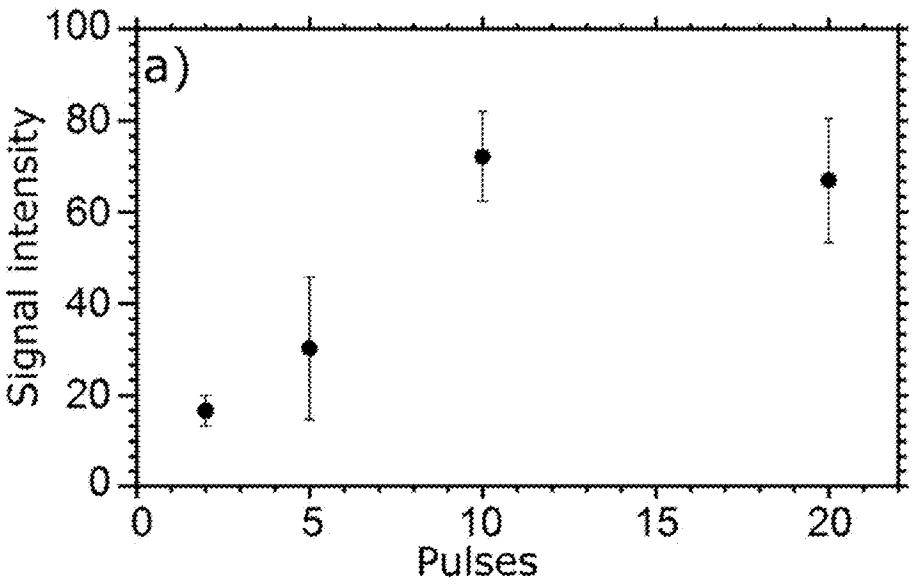
Fig. 2.4B
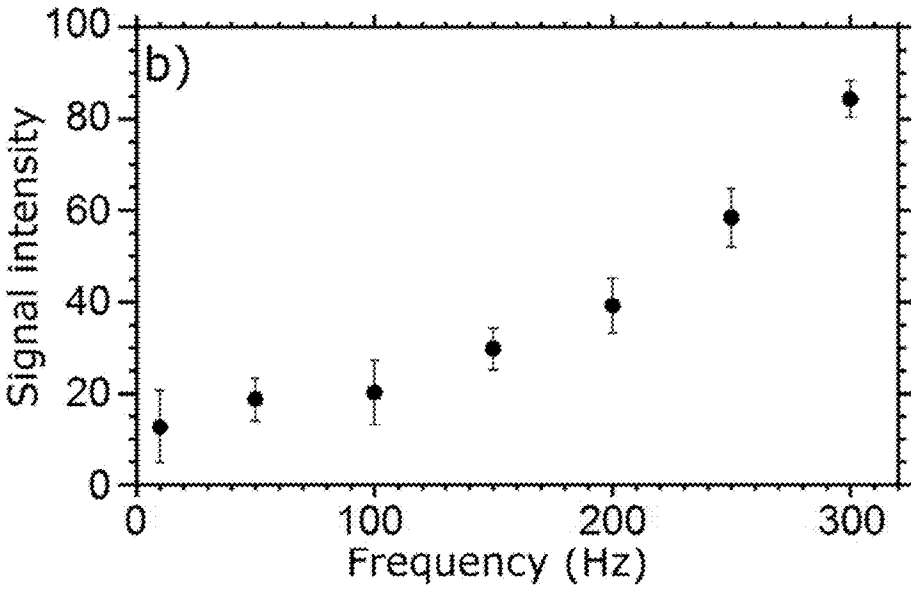

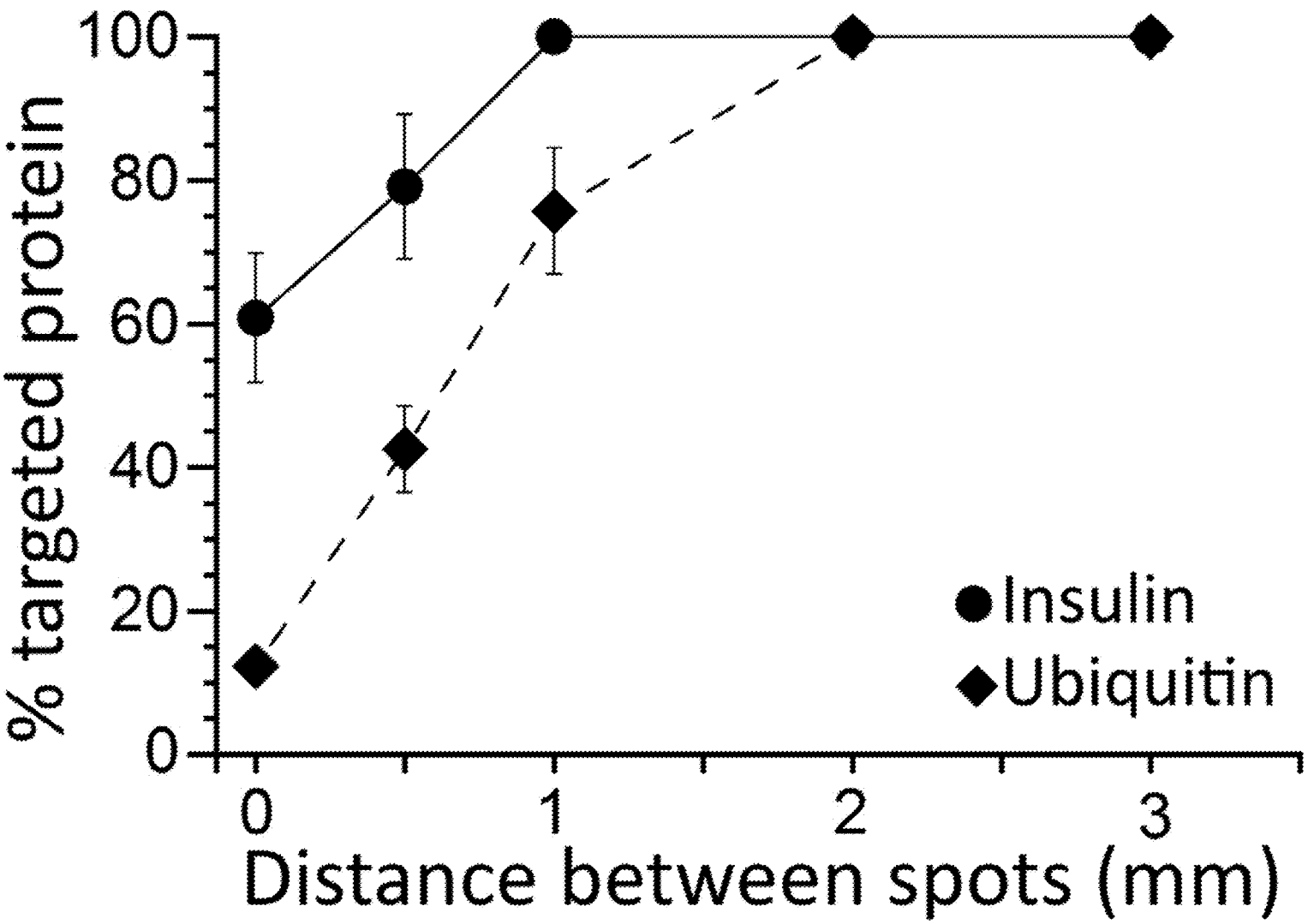
Fig. 2.5

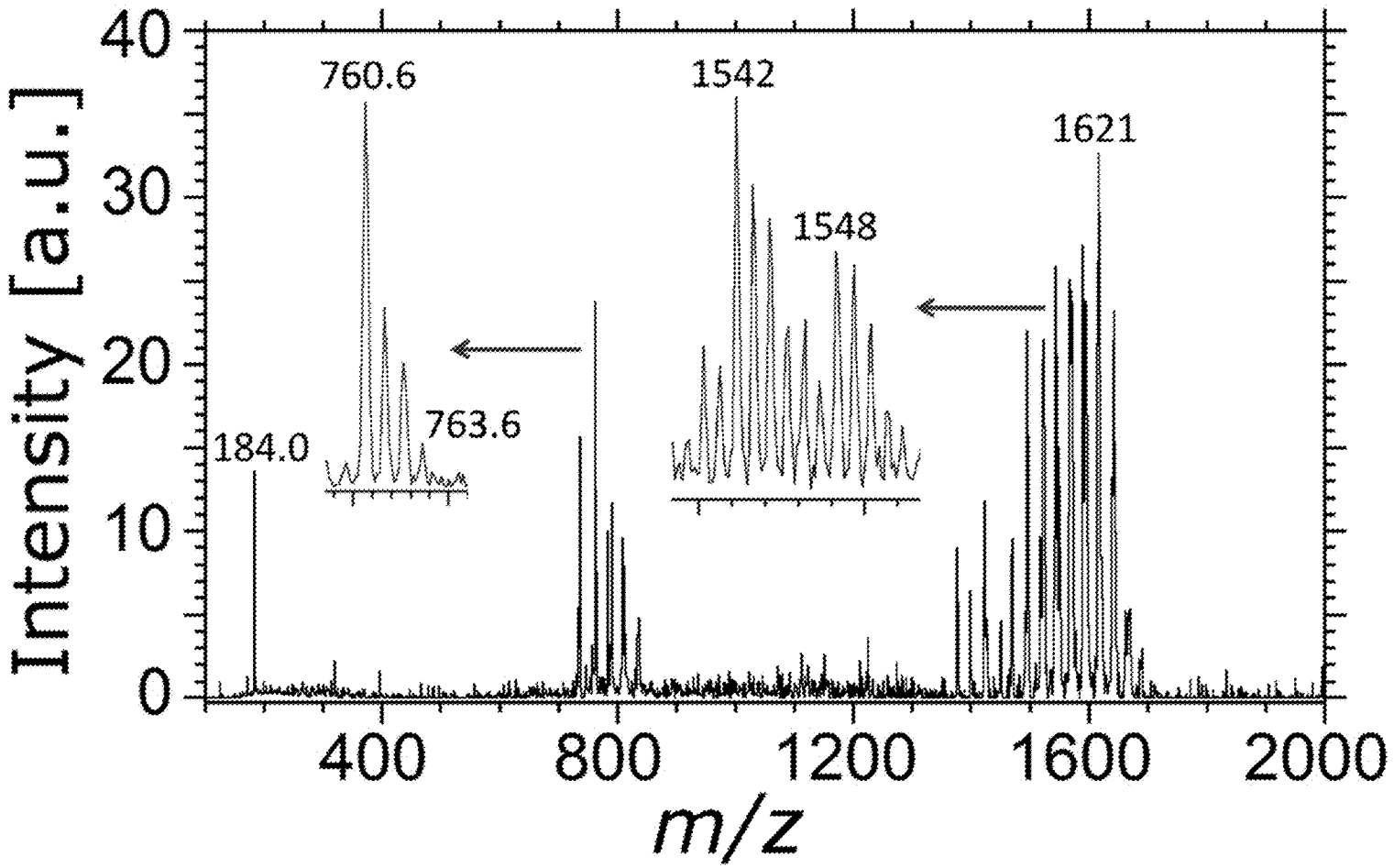
Fig. 2.6

DEVICES AND METHODS FOR MAI IONIZATION

This application claims the benefit of and priority to U.S. Provisional Application Ser. No. 62/592,126, having the title "DEVICES AND METHODS FOR PULSED VALVE IONIZATION", filed on Nov. 29, 2017, the disclosure of which is incorporated herein by reference in its entirety.

STATEMENT REGARDING FEDERALLY SPONSORED RESEARCH OR DEVELOPMENT

This invention was made with Government support under contract CHE-1709526 awarded by the National Science Foundation. The Government has certain rights in the invention.

BACKGROUND

Matrix assisted ionization (MAI) is a general term used to describe a mass spectrometer ion source in which ions are formed by the interaction of an analyte molecule with specific matrix compounds that promote the formation of ions. As with matrix-assisted laser desorption ionization (MALDI), the matrix is mixed with the analyte and deposited and dried on a sample target. Ion formation is associated with the production of particles by laser ablation, mechanical shock, solvent boiling, or sublimation. Some matrix compounds that have been developed for MALDI can also be used for matrix-assisted ionization, but there are many compounds that are unique to MAI. Unlike MALDI, MAI tends to produce ions that are highly charged.

MAI has some potential advantages for mass spectrometry imaging due to its simplicity, low fragmentation, and tandem mass spectrometry facilitated by highly charged ion formation. For imaging in laser-spray mode, a pulsed laser is directed at a thin tissue section in transmission mode (back side irradiation) to create ions by MAI. Matrix-assisted ionization in vacuum (MAIV) can be used for the analysis of tissue by spotting matrix on selected areas and applying vacuum to the entire tissue section. Precision spotting can limit the exposed tissue area to several hundred μm. An alternative approach uses a glass melting point tube to sample from tissue under ambient conditions for MAI. Better temporal and spatial control of ion formation could add significant utility to these imaging approaches.

Precise control of material removal from metal sample surface for mass spectrometry analysis can be achieved using a locally directed shock pulse. Shock-generation of ions for MAI can be implemented in a number of ways. The simplest is to strike a target near the inlet of the mass spectrometer. Other methods for particle production include devices such as a pellet gun or mouse trap to produce a mechanical shock. Laser induced acoustic desorption (LIAD) uses a pulsed nanosecond laser that is directed in transmission geometry at a thin metal foil, which ejects material from the opposite side. Post-ionization can be accomplished using electron ionization, electrospray ionization, and photoionization. A similar approach that does not require a laser nebulizes liquid samples from piezoelectric ally driven targets using surface acoustic wave nebulization (SAWN), which uses a high frequency piezoelectric device to nebulize a thin film of liquid from a surface and bare ions are formed upon solvent evaporation and sampled into a mass spectrometer ion source.

SUMMARY

The present disclosure describes a mass spectrometer system that includes a sample mount configured to hold a sample substrate. The sample substrate can have an opposing front side and a back side, with a sample on the front side of the sample substrate. The system also includes an ionization device that is configured to direct a force at the back side of the sample substrate to propagate a shockwave, where the ionization device is located at a first distance adjacent to the sample mount. Also included is a mass spectrometer with an inlet, and with the sample mount positioned a second distance from the inlet.

The ionization device can be a pulsed valve having a first gas flow port. The first gas flow port can have a closed position and an open position, an inlet and an exit. The pulsed valve can have a gas inlet in gaseous communication with the inlet of the first gas flow port, so that when the first gas flow port is in the closed position, the first gas flow port is configured so that gas does not flow through the first gas flow port. When the first gas flow port is in the open position, the first gas flow port is configured so that gas flows through the inlet and out of the exit of the first gas flow port. The gas exiting the first gas flow port impacts the sample mount, which has a sample positioned thereon. Ions of the sample are produced upon impact of gas on the sample mount, and the ions pass into the inlet.

Alternatively, the ionization device can have a piezoelectric cantilever with a precision striker positioned to impact a rear side of a metal foil attached to the sample mount; so that ions of a sample are produced upon impact of the striker on the metal foil, and the ions pass into the inlet.

Also described is a method for mass spectrometer ionization that includes directing a force at a back side of a sample substrate. A sample, including at least one analyte, is disposed on the front side of the sample substrate opposite of where the force is directed. Ions of one or more of the analytes are formed upon impact of the force on the back side of the sample substrate.

Other compositions, apparatus, methods, features, and advantages will be or become apparent to one with skill in the art upon examination of the following drawings and detailed description. It is intended that all such additional compositions, apparatus, methods, features and advantages be included within this description, be within the scope of the present disclosure, and be protected by the accompanying claims.

BRIEF DESCRIPTION OF THE DRAWINGS

Further aspects of the present disclosure will be more readily appreciated upon review of the detailed description of its various embodiments, described below, when taken in conjunction with the accompanying drawings.

FIG. 1.1 illustrates an example of a setup for pulsed valve matrix assisted ionization.

FIGS. 1.2A-1.2D show mass spectra for 2-NPG matrix-assisted ionization of 1.2A) insulin using tapping, 1.2B) insulin using pulsed valve and 1.2C) ubiquitin tapping, and 1.2D) ubiquitin with pulsed valve.

FIGS. 1.3A-1.3D plot total ion current as a function of time for 2-NPG matrix-assisted ionization of insulin using 1.3A) slide strike, 1.3B) 1 valve pulse, 1.3C) 2 pulses and 1.3D) 5 pulses at 1 Hz repetition starting at 30 s.

FIGS. 1.4A-C provide pulsed valve matrix-assisted ionization mass spectra showing a comparison of 2-NPG, 3-NBN and 2,5-DHAP matrix compounds.

FIGS. 1.5A-C provide a comparison of the time response of the pulsed valve MAI signal for 2-NPG, 3-NBN and 2,5-DHAP.

FIGS. 2.1A-2.1B show examples of a piezoelectric matrix assisted ionization instrument. FIG. 2.1A is a schematic and FIG. 2.1B is a photograph of an example configuration of the cantilever with attached needle tip (right).

FIGS. 2.2A-2.2D show matrix-assisted ionization mass spectra of ubiquitin protein using 2-NPG matrix: total ion current tapping (FIG. 2.2A); total ion current cantilever (FIG. 2.2B); mass spectrum tapping (FIG. 2.2C); mass spectrum cantilever (FIG. 2.2D).

FIGS. 2.3A-2.3B display the total ion current for piezoelectric matrix assisted ionization of insulin using matrices (FIG. 2.3A) 2-NPG, (FIG. 2.3B) 2-NBN, and (FIG. 2.3C) 3-NBN; the insets show the mass spectra for each matrix.

FIGS. 2.4A-2.4B show examples of piezoelectric matrix assisted ionization ion signals for insulin with 2-NBN matrix as a function of (FIG. 2.4A) cantilever strikes at 1 Hz and (2.4B) cantilever frequency.

FIG. 2.5 shows the fractional signal for targeted protein from spots separated by the indicated center to center distance for insulin (●) and ubiquitin (♦). Peaks of +5 and +8 charges were used for insulin and ubiquitin, respectively.

FIG. 2.6 are mass spectra obtained from mouse brain tissue using 2-NBN matrix.

The drawings illustrate only example embodiments and are therefore not to be considered limiting of the scope described herein, as other equally effective embodiments are within the scope and spirit of this disclosure. The elements and features shown in the drawings are not necessarily drawn to scale, emphasis instead being placed upon clearly illustrating the principles of the embodiments. Additionally, certain dimensions may be exaggerated to help visually convey certain principles. In the drawings, similar reference numerals between figures designate like or corresponding, but not necessarily the same, elements.

DETAILED DESCRIPTION

Before the present disclosure is described in greater detail, it is to be understood that this disclosure is not limited to particular embodiments described, and as such may, of course, vary. It is also to be understood that the terminology used herein is for the purpose of describing particular embodiments only, and is not intended to be limiting, since the scope of the present disclosure will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Embodiments of the present disclosure will employ, unless otherwise indicated, techniques of chemistry, physics, and the like, which are within the skill of the art.

The following examples are put forth so as to provide those of ordinary skill in the art with a complete disclosure and description of how to perform the methods and use the devices disclosed and claimed herein. Efforts have been made to ensure accuracy with respect to numbers (e.g., amounts, temperature, etc.), but some errors and deviations should be accounted for. Unless indicated otherwise, parts are parts by weight, temperature is in ° C., and pressure is at or near atmospheric. Standard temperature and pressure are defined as 20° C. and 1 atmosphere.

Before the embodiments of the present disclosure are described in detail, it is to be understood that, unless otherwise indicated, the present disclosure is not limited to particular materials, reagents, reaction materials, manufacturing processes, or the like, as such can vary. It is also to be understood that the terminology used herein is for purposes of describing particular embodiments only, and is not intended to be limiting. It is also possible in the present disclosure that steps can be executed in different sequence where this is logically possible.

It must be noted that, as used in the specification and the appended claims, the singular forms "a," "an," and "the" include plural referents unless the context clearly dictates otherwise.

General Discussion

In accordance with the purpose(s) of the present disclosure, as embodied and broadly described herein, embodiments of the present disclosure, in some aspects, relate to mass spectrometry. Embodiments of the present disclosure provide for mass spectrometry systems, mass spectrometry devices, methods for mass spectrometer ionization, and the like.

The present disclosure describes a mass spectrometer system that includes a sample mount configured to hold a sample substrate. The sample substrate can have an opposing front side and a back side, with a sample on the front side of the sample substrate. The system also includes an ionization device that is configured to direct a force at the back side of the sample substrate to propagate a shockwave, where the ionization device is located at a first distance adjacent to the sample mount. Also included is a mass spectrometer with an inlet, and with the sample mount positioned a second distance from the inlet. In one aspect, a sample including analytes of interest can be ionized using a pulse of gas. In another aspect, a sample including analytes of interest can be ionized using a piezoelectric cantilever striker. Advantageously, no lasers are needed, providing a lower-cost setup for mass spectrometry sampling. Improved temporal and spatial resolution can be achieved using the devices and methods described herein when compared to existing methods such as tapping.

In an embodiment, the mass spectrometer system includes an ionization device. The ionization device can include a pulse valve to control a flow of gas (e.g., gas pulse) used to ionize analytes in a sample by impacting the back of a sample substrate upon which the sample is disposed. In an aspect, the gas pulse releases a pressure nanospray of gas and produces gas phase ions of the at least one analyte. In general, the pulse valve controls pulses of gas that impact the sample substrate. Upon impact, the analyst are ionized and can be sampled by a mass spectrometer having an inlet in close proximity (e.g., mm's to cm's) to the sample. In an aspect, the sample substrate can be pulsed one or more times and/or at different regions of the sample substrate can be pulsed. The gas used to pulse can be an inert gas such as He, Ar, $N_2$, and the like.

In an embodiment, the ionization device can include one or more piezoelectric cantilevers. A precision striker (e.g. a needle, sharp tip, hammer) can be attached to a cantilever. The cantilever is configured to cause the striker to impact the back of a sample substrate upon which the sample is disposed. The sample substrate can be struck one or more times and/or struck at one or more regions. The cantilever can strike a substrate that includes the sample, where the cantilever contacts the side of the substrate on the side opposite the side where the sample is disposed on the substrate. In the alternative, the cantilever can strike a substrate that includes the sample on the side upon which the sample is located, where the cantilever may or may not contact the sample itself. In an embodiment, the piezoelectric cantilever can be a bimorph or a unimorph piezoelectric cantilever. The piezoelectric cantilever can also be other types of strikers or piezoelectric actuators that can be envisioned by one of skill in the art.

In an aspect, the sample mount is adjacent the exit of the first gas flow port or adjacent the cantilever. The sample or the sample substrate can be positioned relative to the ionization device. For example, the sample mount can be positioned in front of the exit of the first gas flow port so that the gas pulse impacts the sample or the sample substrate at the desired location. The distance of the sample mount can adjusted relative to the exit of the first gas flow port. The sample mount is about 0.1 mm to 1 cm away from the exit of the first gas flow port.

In another aspect, the sample mount can be positioned in front of the piezoelectric cantilever so that the strike of the precision striker impacts the sample or the sample substrate at the desired location. The distance of the sample mount can adjusted relative to the dimensions of the striker and/or cantilever to optimize the force depending on the characteristics of the sample substrate (e.g. thickness or type of foil used). The piezoelectric cantilever can have a length on the millimeter scale to centimeter scale, for example about 7 mm to 32 mm or more, or specifically about 32 mm; and can have a width on the millimeter scale to centimeter scale or about 7.8 mm; a free length on the millimeter scale to centimeter scale or about 28 mm; and a maximum displacement on the submillimeter scale to millimeter scale or about 0.45 mm. In other embodiments, the piezoelectric cantilever can have larger or smaller dimensions or displacement depending upon the specific design of the device. The distance of the sample mount from the precision striker tip can be adjusted to optimize the force of the strike. When the piezoelectric cantilever is in an unactuated position (e.g. neutral position), the tip of the precision striker is at a distance from the sample substrate on the micrometer scale to millimeter scale or is about 250 μm from the sample substrate.

In an embodiment, the piezoelectric cantilever is operated at a resonant frequency of about 200 to about 400 Hz, or about 300 Hz. In an aspect, the cantilever can be a bimorph piezoelectric cantilever.

The sample mount can be a structure to secure the sample or sample substrate to the mass spectrometry system. For example, the sample mount can be a clamping system to secure a metal foil that includes sample.

In an aspect, the sample substrate can include the sample on the surface of the sample substrate on the side opposite of the gas pulse or striker impact. The sample substrate can be a foil (e.g., aluminum foil, titanium foil, tungsten) or other material that supports the sample and has the characteristic that upon impact the analytes in the sample are ionized. The foil can be about 10 μm to about 50 μm, or about 25 μm thick.

In an aspect, the sample can include biological components (e.g., proteins, peptides, lipids, gangliosides, and other biological components), chemical components, and the like. In an aspect, the sample can be a biological sample (e.g., tissue, fluid, cell culture, and the like), a chemical sample (e.g., explosives, pollutants, drugs, poisons, and the like), a forensic sample (e.g., a finger print), and the like. In an aspect, when the sample is a biological sample, the ions formed can be largely intact proteins, large polynucleotide strands, and the like.

In an aspect, the sample can include an analyte of interest and a matrix. In various aspects, the matrix can include such as 2-nitrophloroglucinol (2-NPG), 3-nitrobenzonitrile (3-NBN), 2-nitrobenzonitrile (2-NBN), or a co-matrix such as silica nanoparticles. Although not intending to be bound by theory, silica can be used since it may dry the tissue and allow the formation of crystals that are necessary for ion formation. Other matrix compounds could be used as long as they lead to ion formation. Some other matrix compounds are listed in J. Li, E. D. Inutan, B. Wang, C. B. Lietz, D. R. Green, C. D. Manly, et al., Matrix Assisted Ionization: New Aromatic and Nonaromatic Matrix Compounds Producing Multiply Charged Lipid, Peptide, and Protein Ions in the Positive and Negative Mode Observed Directly from Surfaces, J. Am. Soc. Mass Spectrom. 63 (2012) 2069-2073. doi:10.1007/s13361-012-0413-z, which is incorporated herein by reference.

The pulse valve or piezoelectric cantilever can be positioned close to a mass spectrometer so that the generated analyte ions can enter an inlet of the mass spectrometer and be analyzed. The distance from the sample to the inlet can be about 1 mm to 100 cm.

In an aspect, the area or zone around the ionization device, the sample, and the inlet are under a vacuum using appropriate pumping and vacuum systems for mass spectrometry. In an aspect, the mass spectrometer can be an ion trap mass spectrometer, a time-of-flight mass spectrometer, a quadrupole mass filter mass spectrometer, an ICR mass spectrometer, sector mass spectrometer, and quadrupole time-of-flight hybrid mass spectrometer. Once in the mass spectrometer the ions can be appropriately separated and detected using known mass spectrometry systems and detectors.

In an aspect, the pulsed valve has a first gas flow port and has an inlet and an exit. The first gas flow port has a closed position and an open position. The pulsed valve has a gas inlet configured to connect to a gas source. The gas inlet is in gaseous communication with the inlet of the first gas flow port. When the first gas flow port is in the closed position, gas does not flow through the first gas flow port, and when the first gas flow port is in the open position gas flows through the inlet and out of the exit of the first gas flow port. The pulsed valve can also include a mechanism (e.g., actuation) to control the opening and closing of the first gas flow port so that the gas can be pulsed for a controllable time frame and controllable rate. In addition, the pulse valve can include other components to control the gas flow, gas pressure, and the like. In an embodiment, the pulsed valve can include a first gas flow port and a second gas flow port or additional gas flow ports. In an aspect, the pulsed valve can be made of stainless steel, steel, aluminum, plastic, or a combination thereof.

In an embodiment, the pulsed valve can be a solenoid valve such as a Parker Series 9 solenoid valve sold by Parker Hannifin or other similar solenoid valves. In an aspect, the solenoid valve can have an exit orifice diameter of about 0.25 to about 1 mm.

In an embodiment, the opening and closing of the first gas flow port of the pulsed valve (also can be referred to as opening and closing of the pulsed valve or solenoid valve) can be a pulsing system that uses an electronic pulse to move the first gas flow port from the closed position to the open position. The pulsing system can be an electronic system in communication with the pulse valve where a voltage can be used to actuate the opening and closing of the pulsed valve, and the Example provides an example of how this is achieved. In an aspect, the pulsed valve is connected to a high voltage power supply, and the power supply actuates the valve via a switch. In various embodiments, the high voltage switch provides at least one pulse of about 200 to about 400 V, or about 280 V. In an aspect, the pulse has a pulse duration of about 250-100 μs and can be pulsed at a rate of single pulse to 200 Hz.

In an embodiment, the mass spectrometer system includes a gas input system to supply the gas to the pulse valve. The gas input system is in gaseous communication with the gas inlet of the pulse valve. The gas from the gas input system can be discharged at a pressure of about 500 kPa to 700 kPa or more. In an embodiment, the gas input system can be left in the open position and the pulse valve can be used to pulse the gas for desired duration and rate.

Embodiments of the present disclosure also include methods for mass spectrometer ionization. In general, the pulse valves and piezoelectric cantilevers described herein can be used to ionize the target analytes in the sample.

In an aspect, a pulse of gas can be directed at a back side of a sample or a sample substrate (e.g., a foil including a sample on the surface). In particular aspects, the first gas flow port of the pulsed valve can be opened so that gas flows through the first gas flow port toward the back side of the sample substrate. The first gas flow port can be opened and closed for a desired period of time and/or at a desired rate to generate the ions. More particularly, the sample substrate is disposed on the sample mount adjacent the exit of the first gas flow port so that the gas exiting the first gas flow port for the desired period of time and/or at the desired rate impacts the back side of the sample substrate.

In particular aspects, at least one piezoelectric cantilever is positioned so that the precision striker is pointed toward the back side of the sample substrate. The cantilever can be operated at a desired frequency for a number of strikes to generate ions of target analytes. The impact of the pulse of gas or the piezoelectric strike on the backside of the sample substrate causes ions of one or more of the analytes to be formed.

After the force of the gas pulse or piezoelectric cantilever strike, the formed ions can then be detected using a detection system such as a mass spectrometry system as described herein. In particular, the ions of the one or more analytes can be sampled using the mass spectrometer, where the ions enter the mass spectrometer through the inlet of the mass spectrometer that is positioned a distance from the sample mount.

EXAMPLES

Now having described the embodiments of the disclosure, in general, the examples describe some additional embodiments. While embodiments of the present disclosure are described in connection with the example and the corresponding text and figures, there is no intent to limit embodiments of the disclosure to these descriptions. On the contrary, the intent is to cover all alternatives, modifications, and equivalents included within the spirit and scope of embodiments of the present disclosure.

Example 1

The modified mass spectrometer ion source comprises a pulsed valve that is aimed at the back side of a metal foil that has an inlet ionization matrix and analyte deposited on the front. Ions created at ambient pressure are sampled by the inlet of the mass spectrometer. A diagram of the ion source is shown in FIG. 1.1. The pulsed valve was a Parker Series 9 solenoid valve with an orifice diameter of 0.51 mm and a nitrogen gas backing pressure of 90 psig (600 kPa gauge pressure). The valve was actuated with a 280 V high voltage pulse of 500 μs duration provided by a high voltage switch (Model GRX-3, Directed Energy, Fort Collins, Colo.) and high voltage power supply (RR3-15R, Gamma, Ormond Beach, Fla.) driven by a pulse and delay generator (DG 535, Stanford Research Systems, Sunnyvale, Calif.).

The sample target was a 250 μm thick sheet of aluminium foil (Reynolds Wrap, Alcoa, Pittsburgh, Pa.) that was mounted between two 0.64 mm thick 5 cm square stainless steel plates with a central 25 mm hole (Kimball Physics, Wilton, N.H.). The foil was held 1 mm from the pulsed valve orifice with the opposite side 9 mm from the inlet of an ion trap mass spectrometer (Amazon Speed ETD, Bruker, Bremen, Germany). Both the valve and the sample holder were placed on a translation stage to adjust the distance from the mass spectrometer inlet. The electrospray interface was removed for inlet ionization operation and the inlet was heated to 350° C. Samples were analyzed in Ultrascan mode at 32500 m/z sec.

The reagents 2,5-dihydroxyacetone phosphate (2,5-DHAP), 2-nitrophloroglucinol (2-NPG), 3-nitrobenzonitrile (3-NBN), formic acid (FA), bovine insulin, and bovine erythrocytes ubiquitin were purchased from Sigma-Aldrich (St. Louis, Mo.). HPLC grade acetonitrile (ACN) and water were purchased from Honeywell (Morris Plains, N.J.). A solution of 10 μM bovine insulin was prepared in 1:1 ACN:0.1% FA and ubiquitin in HPCL grade water. Saturated solutions of 2,5-DHAP, 2-NPG, matrix solutions were prepared in 1:1 acetonitrile:water and 3-NBN was prepared in ACN. To create a sample deposit, 1 μL of analyte was deposited on the aluminium foil followed immediately by 2 μL of matrix solution and air dried.

Results and Discussion

The pulsed valve matrix-assisted ionization configuration was installed at the inlet of the ion trap mass spectrometer in nanospray configuration (CaptiveSpray) with the commercial spray source removed and the interlock defeated. The foil was held vertically and placed as close as practical to the mass spectrometer with the MAI deposit facing the inlet. The pulsed valve was placed just behind the foil and backed with high pressure nitrogen gas. It was found that the highest gas pressure gave the highest signal. Conventional MAI was accomplished by removing the pulsed valve and foil and tapping a microscope slide with a matrix and analyte deposit against the side of the inlet.

MAI mass spectra of the proteins insulin and ubiquitin are shown in FIGS. 1.2A-1.2D. A 1 μL volume of 10 μM protein was droplet dried on the foil target with 2 μL of 2-NPG matrix and allowed to dry. The resulting spot was approximately 3 mm in diameter. The mass spectrum shown in FIG. 1.2A results from insulin deposited on a glass slide and tapped against the inlet of the mass spectrometer. The pulsed valve matrix-assisted ionization of the same solution is shown in FIGS. 1.2B. A total of 5 pulses at 1 Hz repetition rate were used. FIG. 1.2C is the mass spectrum of the protein ubiquitin from microscope slide tapping and FIG. 1.2D is the corresponding pulsed valve matrix-assisted ionization mass spectrum of ubiquitin. The mass spectra are comparable, although the pulsed valve matrix-assisted ionization spectra are approximately a factor of two larger than the mass spectra obtained by tapping.

Mass spectra obtained using other inlet ionization matrix compounds produced similar results: pulsed valve matrix-assisted ionization mass spectra showing a comparison of 2-NPG, 3-NBN and 2,5-DHAP matrix compounds is shown in FIGS. 1.4A-1.4C. The 3-NBN produced the largest signal and the analyte signal intensity was more than 150 times as intense as with 2-NPG and 300 times more intense than 2,5-DHAP, consistent with previously reported results.[7] The 2-NPG produced analyte with the highest charge state.

To assess the number of valve pulses required to deplete the sample was performed using 2-NPG matrix. FIGS. 1.3A-1.3D show the total ion current as a function of time for MAI of insulin. FIG. 1.3A results from striking a glass slide with sample deposit on the mass spectrometer at 30 s elapsed time. FIG. 1.3B shows the TIC as a function of time for 1 valve pulse, FIG. 1.3C for 2 pulses at 1 Hz, and FIG. 1.3D for 5 pulses at 1 Hz. In all cases, the maximum signal is achieved after approximately 2 s and decayed rapidly with an approximately 2 s time constant. The integrated ion signal for 2 and 5 pulses (and for 10, 20 and continuous pulses not shown) was similar and approximately twice the total intensity of a single pulse. This suggests that approximately half of the available particulate was removed with the initial pulse and nearly all of the remainder with the second pulse. A second broad ion signal maximum is observed between 40 and 60 s in the FIG. 1.3A-1.3D plots, which suggests two modes or regions of ionization and may be related to the bimodal particle size distribution for inlet ionization matrices that has been observed previously.[20]

A comparison of the time response of the pulsed valve MAI signal for 2-NPG, 3-NBN and 2,5-DHAP is shown in supplementary FIGS. 1.5A-1.5C. In these plots, the pulsed valve was fired five times at a repetition rate of 1 Hz at a time of 30 s. For all of the matrix compounds, maximum signal was observed about 2 s after the valve was fired, decreased rapidly with a 2 s time constant and a lower intensity tail returning to baseline within 30 s.

Conclusions

The present disclosure describes a new ion source for matrix-assisted ionization with high temporal resolution. A high-pressure electric solenoid pulsed valve directed at a thin metal foil was capable of ionizing the available material in the sample within 5 seconds of valve actuation. This source has applications in matrix-assisted ionization imaging both at ambient pressure and under vacuum and shock wave technology that has been developed for biomedical applications.[21-23] Aspects of the present disclosure have applications for precision MAI imaging. Aspects of the present disclosure can be used in a temporally and spatially focused system capable of selectively producing inlet ionization from an array of tissue samples.

EXAMPLE 1 REFERENCES

1 S. Trimpin, B. Wang, C. B. Lietz, D. D. Marshall, A. L. Richards and E. D. Inutan, Crit. Rev. Biochem. Mol. Biol., 2013, 48, 409-429.
2 S. Trimpin, J. Am. Soc. Mass Spectrom., 2015, 27, 4-21.
3 P. M. Peacock, W.-J. Zhang and S. Trimpin, 2017, 89, 372-388.
4 K. Dreisewerd, Anal. Bioanal. Chem., 2014, 406, 2261-2278.
5 S. Trimpin, B. Wang, E. D. Inutan, J. Li, C. B. Lietz, A. Harron, V. S. Pagnotti, D. Sardelis and C. N. McEwen, J. Am. Soc. Mass Spectrom., 2012, 23, 1644-1660.
6 T. Musapelo and K. K. Murray, Rapid Commun. Mass Spectrom., 2013, 27, 1283-1286.
7 J. Li, E. D. Inutan, B. Wang, C. B. Lietz, D. R. Green, C. D. Manly, A. L. Richards, D. D. Marshall, S. Lingenfelter, Y. Ren and S. Trimpin, J. Am. Soc. Mass Spectrom., 2012, 63, 2069-2073.
8 C. B. Lietz, A. L. Richards, Y. Ren and S. Trimpin, Rapid Commun. Mass Spectrom., 2011, 25, 3453-3456.
9 V. S. Pagnotti, E. D. Inutan, D. D. Marshall, C. N. McEwen and S. Trimpin, 2011, 83, 7591-7594.
10 A. L. Richards, C. B. Lietz, J. B. Wager-Miller, K. Mackie and S. Trimpin, Rapid Commun. Mass Spectrom., 2011, 25, 815-820.
11 E. D. Inutan and S. Trimpin, Mol. Cell. Proteomics, 2013, 12, 792-796.
12 V. V. Golovlev, S. L. Allman, W. R. Garrett, N. I. Taranenko and C. H. Chen, Int. J. Mass Spectrom., 1997, 169, 69-78.
13 J. Perez, L. E. Ramirez-Arizmendi, C. J. Petzold, L. P. Guler, E. D. Nelson and H. I. Kenttamaa, Int. J. Mass Spectrom., 2000, 198, 173-188.
14 S.-C. Cheng, T.-L. Cheng, H.-C. Chang and J. Shiea, 2009, 81, 868-874.
15 L. Jia, J. Weng, Z. Zhou, F. Qi, W. Guo, L. Zhao and J. Chen, Rev. Sci. Instrum., 2012, 83, 026105.
16 U. Sezer, L. Wörner, J. Horak, L. Felix, J. Tüxen, C. Götz, A. Vaziri, M. Mayor and M. Arndt, 2015, 87, 5614-5619.
17 K. Benham, R. Hodyss, F. M. Fernández and T. M. Orlando, J. Am. Soc. Mass Spectrom., 2017, 1-8.
18 S. Heron, R. Wilson, S. Shaffer, D. R. Goodlett and J. Cooper, 2010, 82, 3985-3989.
19 Y. Huang, S. Heron, S. H. Yoon and D. R. Goodlet, in Ambient Ionization Mass Spectrometry, eds. M. Domin and R. Cody, Royal Society of Chemistry, Cambridge, 2014.
20 T. Musapelo and K. K. Murray, J. Am. Soc. Mass Spectrom., 2013, 24, 1108-1115.
21 J. E. Lingeman, J. A. McAteer, E. Gnessin and A. P. Evan, Nat. Rev. Urol., 2009, 6, 660-670.
22 P. Lukes, F. Fernández, J. Gutiérrez-Aceves, E. Fernández, U. M. Alvarez, P. Sunka and A. M. Loske, Shock Waves, 2017, 26, 1-23.
23 A. M. Loske, Medical and Biomedical Applications of Shock Waves, Springer International Publishing, 2017.

Example 2

As described in Example 1, a pulsed valve method has been developed for precise temporal and spatial control of MAI in which a high-speed pulsed valve was used to direct a high-pressure gas pulse at the back side of a thin foil with a MAI sample on the opposite side facing the MS inlet.[8] The shock from the gas pulse creates a plume of ions that are sampled into the mass spectrometer. The approach of gas-pulse driven MAI was demonstrated for the ionization of peptide and protein molecules from ambient conditions. Compared to tapping methods, the pulsed valve provides better temporal resolution; however the spatial resolution achieved with the pulsed valve is limited.

Thus, a piezoelectric cantilever based method was developed for temporally and spatially localized ion formation for MAI that uses a voltage pulse and does not require a high-pressure gas. Here, a piezoelectric bimorph cantilever with a sharp tip attached to the arm was used as an electrically-driven striker on a thin metal foil with a MAI sample on the opposite side. When the cantilever is actuated, the needle strikes the foil and the material ejected from the other side forms ions when introduced into the mass spectrometer inlet. The piezoelectric cantilever configuration was used for ionization of peptides and protein standards as well as lipids and gangliosides from thin tissue sections under ambient conditions.

Experimental

A piezoelectric bimorph cantilever (PB4NB2S, Thorlabs, Newton, N.J.) was used to remove samples deposited on a thin metal foil. The piezoelectric cantilever has a length of 32 mm, width of 7.8 mm, and a 28 mm free length with maximum displacement of 0.45 mm. The resonant frequency of the bare cantilever is 370 Hz. A 4 mm section from the tip of a 100 μm diameter sewing needle was attached to the end of the arm of a cantilever with cyanoacrylate glue which added a mass of approximately 40 mg to the cantilever. The modified cantilever was operated at 300 Hz which was the highest frequency possible with the added mass; higher frequencies caused overheating and damaged the cantilever. Aluminum foil (13, 25 and 50 μm; Reynolds Wrap, Pittsburgh, Pa.), tungsten foil (50 μm) and titanium foil (13 and 25 μm; Alfa Aesar, Ward Hill, Mass.) were used for the experiments described below. The foil containing the sample was mounted between two 0.64 mm thick 5 cm square stainless plates with a central 25 mm hole (Kimball Physics, Wilton, N.H.), similar to previously described.[8] The foil was held approximately 250 μm from the tip of the needle with the sample side 4 mm from the inlet of the mass spectrometer. FIG. 2.1 shows the schematic of the ion source and the modified cantilever.

The mass spectrometer used for this experiment is an ion trap mass spectrometer (Amazon Speed ETD, Bruker, Bremen, Germany). The captive spray interface was removed for inlet ionization operation and the glass capillary inlet was heated to maximum of 350° C. Before removing the interface, the voltage was turned off and the gas was disconnected. Samples were analyzed in Ultrascan mode between 100 m/z to 3000 m/z at 32,500 m/z sec on positive ion mode. Data collected were analyzed using the instrument control software (Bruker Compass 4.1).

Stock solutions of protein standards were prepared in HPLC grade water (Sigma-Aldrich, St. Louis, Mo.) and diluted to 10 μM. Additional solvents were lab grade ethanol, HPLC grade acetonitrile (ACN) and trifluoroacetic acid (TFA; Thermo Fisher Scientific, Waltham, Md.) and ammonium bicarbonate (ABC; Sigma-Aldrich). Protein standards insulin, cytochrome C, myoglobin, ubiquitin, and matrix compounds 2-nitrophloroglucinol (2-NPG), 3-nitrobenzonitrile (3-NBN), and 2-nitrobenzonitrile (2-NBN) were obtained from Sigma-Aldrich. The three matrices were selected because of their ability to produce high intensity multiply charged ions.[5,8] Stock solutions at 1 mM concentration were prepared for all proteins. Ubiquitin, cytochrome C, and myoglobin were prepared in HPLC grade water whereas insulin had 0.1% TFA added. Matrix solutions were prepared by dissolving 10 mg of 2-NPG in 200 μL of 1:1 ACN: water with 0.1% TFA, and 10 mg of 2-NBN or 3-NBN in 100 μL of ACN with 0.1% TFA. The sample target was a thin metal foil and sample deposits were formed by depositing 0.5 μL analyte on the foil followed by 0.5 μL matrix solution and mixing on the foil using the pipette tip. An additional 0.5 μL of matrix was deposited on top of the spot and left to dry. The resulting sample spots approximately 1 mm in diameter were used for the experiments described below.

Mouse brain tissue was obtained from the LSU School of Veterinary Medicine Division of Laboratory Animal Medicine (DLAM) as described previously using procedures approved by the LSU Institutional Animal Care and Use Committee (IACUC).[9] Sections 10 μm thick were prepared from frozen tissue with a cryostat (CM1850, Leica Microsystem, Wetzlar, Germany), thaw mounted on foil, and stored at −80° C. Prior to analysis, the sections were thawed and dried under rough vacuum for 10 min to remove moisture from the tissue. Silica nanoparticles 20 nm in diameter (US Research Nanomaterials, Houston, Tex.) were sprinkled from a spatula onto the tissue to form a uniform layer. The matrix solution was then deposited using a micropipette onto nanoparticle treated tissue and allowed to dry.

Results and Discussion

The cantilever and foil were mounted at the inlet of the mass spectrometer. Initially, a bare cantilever was used to strike the surface either parallel to the surface or at a 45° angle. However, the flat edge of the cantilever distributed the force over a large area and was not efficient at material removal. To concentrate the force of the strike, approximately 4 mm of a sewing needle tip was attached to the end of the arm. The distance between the foil and the MS inlet was optimized for the highest signal intensity at a distance of 4 mm. Driving the cantilever with the added mass at frequencies above 300 Hz of the needle tip resulted in overheating and failure of the bimorph. Tungsten, aluminum and titanium were tested and it was found that it was difficult to remove material from the relatively thick and inflexible 50 μm tungsten foil and ionization was not observed. Aluminum (13, 25 and 50 μm) and titanium (13 and 25 μm) foils produced ions. Material removal from the thinner foils was more efficient; however, the 13 μm thick foils were susceptible to damage by tearing. Though the goal was to remove material efficiently with each strike, care was taken such that the striker did not penetrate the foil. All the experiments described below were performed with 25 μm thick aluminum foil.

A comparison of piezoelectric driven MAI and manual tapping is shown in FIGS. 2.2A-D. A 0.5 μL volume of a 10 μM ubiquitin solution was deposited on the aluminum foil followed by two deposits of 0.5 μL of 2-NPG matrix which was mixed and allowed to dry. To create ions by manual tapping, the foil target was tapped once on the inlet capillary. For the piezoelectric configuration, 20 pulses at 300 Hz were used to remove material from the foil. FIGS. 2.2A and 2.2B show the ion signal obtained by manual tapping and piezoelectric cantilever, respectively, as a function of time (strike at 20 s). The signal obtained from tapping (FIG. 2.2A) was slightly higher than from the cantilever (FIG. 2.2B) in a triplicate measurement. In the corresponding mass spectra, the charge distribution of peaks in the mass spectra from tapping (FIG. 2.2C) is similar to that from piezoelectric strike (FIG. 2.2D) with the maximum peak intensity observed for the +8 charge state in both cases. Mass spectra of cytochrome C and myoglobin (data not shown) also contained peaks from highly charged ions.

The MAI matrices 2-NPG, 2-NBN and 3-NBN were tested and compared using the cantilever striker. A capillary inlet temperature of 350° C. was used for 2-NPG whereas 200° C. was used for 2-NBN and 3-NBN. The total ion signal and mass spectra obtained using 20 pulses at 300 Hz are shown in FIGS. 2.3A-2.3C for each matrix. Of the three matrices, 2-NPG had the lowest peak signal intensity and longest signal duration with a decay time of 25 seconds obtained by fitting a single exponential to the data. The 2-NBN and 3-NBN had comparable peak signal intensity and had decay times of 9 and 6 seconds, respectively. The 2-NBN had a larger integrated signal intensity that was approximately four times larger than 3-NBN and 250 times larger than 2-NPG.

The number and frequency of cantilever strikes for efficient removal of sample material was assessed using 2-NBN and insulin. To determine the number of pulses required for complete removal of material, the cantilever was operated at a frequency of 1 Hz and number of strikes was varied. FIG. 2.4A shows the total ion current for all insulin charge states as a function of the number of strikes. Three trials were done for each experiment and the error bars represent one standard deviation from 3 replicate experiments. The signal reached its maximum after approximately ten strikes, suggesting that this number is required to completely remove the deposit from the foil. Similar experiments were performed for 3-NBN and 2-NPG and it was found that ten strikes were required for the former and five for the latter to completely remove the deposit from the foil.

To assess the effect of the cantilever driving frequency, a burst of ten pulses was applied to the foil at a range of frequencies. A new spot was analyzed for each strike and the total ion intensity was recorded. Results for 2-NBN and insulin are shown in FIG. 2.4B. The observed signal increases up to a frequency of 300 Hz; the cantilever could not be operated at higher frequencies without damage. Similar results were obtained for 3-NBN and 2-NPG (data not shown). For the remaining experiments described below, the cantilever was operated with ten strikes at 300 Hz frequency for optimum removal of material from the foil.

An assessment of lateral resolution of the system was performed using pairs of deposited sample spots of proteins ubiquitin and insulin. Individual deposits of ubiquitin and insulin were deposited on aluminum foil separated by 0 (overlapping), 0.5, 1, 2, or 3 mm. The goal was to strike one spot and determine how close the second spot could be without producing signal from the second protein. The cantilever was set to strike the center of either the ubiquitin spot or the insulin spot with ten strikes at 300 Hz. FIG. 2.5 shows the signal intensity for the insulin +5 peak and the ubiquitin +8 peak for striking either the ubiquitin spot or the insulin spot plotted as a function of the center to center distance between the spots. When the distance from the strike point (at spot center) to the center of the adjacent spot is 1 mm or more, primarily the targeted protein is observed. At 1 mm center to center distance between spots, more than 75% of the signal corresponds to ubiquitin when the ubiquitin spot is targeted and struck and close to 100% of the signal corresponds to the insulin when the insulin spot is targeted and struck. This suggests that the piezoelectrically driven tip can remove material from a region localized to approximately 1 mm.

The piezoelectric cantilever striker was tested for ionization of biomolecules from tissue using a 10 μm mouse brain tissue section mounted on aluminum foil. After sectioning, the tissue was stored at −80° C. and was thawed, dried under vacuum, washed with 70% ethanol followed by 90% ethanol, and dried again under vacuum.[9] Matrix was deposited on the tissue as a 1 μL spot and allowed to dry. No signal from the tissue could be observed using the above sample preparation either with or without washing. To create a more easily displaced sample deposit, silica nanoparticles were deposited on the tissue after washing and prior to matrix addition. It was found that these particles produced a deposit at the surface of the tissue that could be removed by the piezoelectric striker. Approximately 0.5 mg of 20 nm silica NPs were sprinkled over an area of approximately 3 $mm^2$ on the tissue followed by a 1 μL volume of matrix solution. A mass spectrum resulting from 10 strikes on tissue with a matrix and nanoparticle co-matrix deposit is shown in FIG. 2.6. Phospholipids and gangliosides were detected from the tissue; no signal at higher m/z was observed. The molecules detected were identified by comparison the results from previous work.[10-12] No multiply charged ions of these species were observed.

The mass spectra obtained with the piezoelectric cantilever are similar to those obtained previously with a high pressure pulsed valve.[8] The decay time constant obtained by fitting to a single exponential curve was less than 5 seconds for all three matrices using the pulsed valve, whereas it ranged from 6 to 25 seconds with the piezoelectric striker. This may be due to the relatively localized piezoelectric strike which may not remove the entire sample and could result in delayed emission from the surrounding area. Contrastingly, the pulsed valve rapidly ejects all of the material in a short period of time leaving no residual.

The mass spectra from the tissue sample using the piezoelectric striker and nanoparticle co-matrix were compared to those obtained previously with laserspray matrix assisted ionization:[13] doubly charged gangliosides were observed from mouse brain tissue using 337 nm laserspray inlet ionization MAI in negative ion mode. This contrasts with the work reported above in which singly charged ions were observed. Proteins have been observed from tissue samples using matrix-assisted ionization in vacuum in which the tissue sample is subjected to a vacuum source and ions are formed during the sublimation process.[14]

Conclusions

A new method for sample introduction for matrix assisted ionization has been developed that uses a piezoelectric cantilever striker. It was found that 25 μm thick aluminum foil provided an excellent target surface for the striker: thicker foils did not produce ions and thinner foils tended to tear. A needle tip attached to the cantilever allowed localization of the striking force to a zone of approximately 1 mm in diameter. The duration of the ion signal following the strike ranged from 10 to 40 seconds. The matrix 2-NBN was found to give the best overall performance for the system under present conditions. It was found that a silica nanoparticle co-matrix assisted in producing singly-charged ions from thin tissue sections using the striker. This contrasts to previous studies under ambient conditions that have produced multiply-charged ions and suggests that there may be some utility in using the piezoelectric striker matrix assisted ionization approach under full or partial vacuum. The piezoelectric cantilever system has potential applications for imaging using matrix-assisted ionization. The piezoelectric device used for this study is relatively large with a low resonant frequency yet was still able to achieve relatively good spatial precision.

EXAMPLE 2 REFERENCES

1. Trimpin S, Lee C, Weidner S M, et al. Unprecedented Ionization Processes in Mass Spectrometry Provide Missing Link between ESI and MALDI. ChemPhysChem 2018; 19: 581-589. doi: 10.1002/cphc.201800144.

2. Trimpin S, Karki S, Marshall D D, et al. Combining Novel and Traditional Ionization Methods for Mass Spectrometry for More Comprehensive Analyses. LC GC N. Am 2018; 16: 12.
3. Dreisewerd K. Recent methodological advances in MALDI mass spectrometry. Anal. Bioanal. Chem. 2014; 406: 2261-2278. doi: 10.1007/s00216-014-7646-6.
4. Musapelo T and Murray K K. Size distributions of ambient shock-generated particles: implications for inlet ionization. Rapid Commun. Mass Spectrom. 2013; 27: 1283-1286. doi: 10.1002/rcm.6568.
5. Trimpin S and Inutan E D. Matrix assisted ionization in vacuum, a sensitive and widely applicable ionization method for mass spectrometry. J. Am. Soc. Mass. Spectrom. 2013; 24: 722-732. doi: 10.1007/s13361-012-0571-z.
6. McEwen C N, Pagnotti V S, Inutan E D, et al. New paradigm in ionization: multiply charged ion formation from a solid matrix without a laser or voltage. Anal. Chem. 2010; 82: 9164-9168. doi: 10.1021/ac102339y.
7. Lietz C B, Richards A L, Ren Y, et al. Inlet ionization: protein analyses from the solid state without the use of a voltage or a laser producing up to 67 charges on the 66 kDa BSA protein. Rapid Commun. Mass Spectrom. 2011; 25: 3453-3456. doi: 10.1002/rcm.5233.
8. Banstola B and Murray K K. Pulsed valve matrix-assisted ionization. Analyst 2017; 142: 1672-1675. doi: 10.1039/c7an00489c.
9. Banstola B, Grodner E T, Cao F, et al. Systematic assessment of surfactants for matrix-assisted laser desorption/ionization mass spectrometry imaging. Anal. Chim. Acta 2017; 963: 76-82. doi: 10.1016/j.aca.2017.01.054.
10. Hsu F-F and Turk J. Electrospray ionization/tandem quadrupole mass spectrometric studies on phosphatidylcholines: the fragmentation processes. J. Am. Soc. Mass. Spectrom. 2003; 14: 352-363. doi: 10.1016/S1044-0305(03)00064-3.
11. Tsui Z-C, Chen Q-R, Thomas M J, et al. A method for profiling gangliosides in animal tissues using electrospray ionization-tandem mass spectrometry. Anal. Biochem. 2005; 341: 251-258. doi: 10.1016/j.ab.2005.03.036.
12. Bond M R, Whitman C M and Kohler J J. Metabolically incorporated photocrosslinking sialic acid covalently captures a ganglioside-protein complex. Mol. Biosyst. 2010; 6: 1796-1799. doi: 10.1039/COMB00069H.
13. Richards A L, Lietz C B, Wager-Miller J, et al. Localization and imaging of gangliosides in mouse brain tissue sections by laserspray ionization inlet. J. Lipid Res. 2012. doi: 10.1194/jlr.D019711.
14. Inutan E D and Trimpin S. Matrix assisted ionization vacuum, a new ionization method for biological materials analysis using mass spectrometry. Mol. Cel. Proteomics 2012: mcp. M112. 023663. doi: 10.1074/mcp.M112.023663.

Clauses

The present disclosure can be described in accordance with the following numbered Clauses.

Clause 1. A mass spectrometer system comprising an ionization device including: a pulsed valve having a first gas flow port, wherein the first gas flow port has a closed position and an open position, wherein the first gas flow port has an inlet and an exit, wherein the pulsed valve has a gas inlet in gaseous communication with the inlet of the first gas flow port, wherein when the first gas flow port is in the closed position, gas does not flow through the first gas flow port, wherein when the first gas flow port is in the open position gas flows through the inlet and out of the exit of the first gas flow port; a sample mount adjacent the exit of the first gas flow port so that gas exiting the first gas flow port impacts a sample positioned on the sample mount; and a mass spectrometer having an inlet, wherein the sample mount is positioned a first distance from the inlet, wherein ions produced upon impact of gas on the sample pass into the inlet.

Clause 2. The mass spectrometer system of clause 1, wherein the pulsed valve is a solenoid valve.

Clause 3. The mass spectrometer system of clause 2, wherein the pulsed solenoid valve has an orifice diameter of about 0.25 to about 1 mm.

Clause 4. The mass spectrometer system of clause 1, further comprising a pulsing system that uses a pulse to move the first gas flow port from the closed position to the open position, wherein the pulse has a pulse duration of about 250-100 μs.

Clause 5. The mass spectrometer system of clause 1, further comprising a gas input system in gaseous communication with the gas inlet of the pulse valve, wherein the gas from the gas input system is discharged at a pressure of about 500 kPa to about 700 kPa.

Clause 6. The mass spectrometer system of clause 1, wherein the mass spectrometer is selected from an ion trap mass spectrometer, a time-of-flight mass spectrometer, a quadrupole mass filter mass spectrometer, an ICR mass spectrometer, a sector mass spectrometer, and a quadrupole time-of-flight hybrid mass spectrometer.

Clause 7. A method for mass spectrometer ionization comprising: directing a pulse of gas at a back side of a sample substrate, wherein a sample is disposed on a front side of the sample substrate on side opposite of where the pulse of gas is directed, wherein the sample includes at least one analyte; and forming ions of one or more of the analytes upon impact of the pulse of gas on the back side of the sample substrate.

Clause 8. The method of clause 7, wherein directing includes opening a first gas flow port of a pulsed valve so that gas flows through the first gas flow port toward the back side of the sample substrate.

Clause 9. The method of clause 8, wherein the sample substrate is disposed on a sample mount adjacent the exit of the first gas flow port so that the gas exiting the first gas flow port impacts the back side of the sample substrate.

Clause 10. The method of clause 7, wherein the pulsed valve is a solenoid valve.

Clause 11. The method of clause 7, wherein the pulsed solenoid valve has an orifice diameter of about 0.25 to about 1 mm.

Clause 12. The method of clause 7, wherein the pulse of gas has a pulse duration of about 250-100 μs.

Clause 13. The method of clause 7, wherein the pulse of gas is discharged at a pressure of about 500 kPa to about 700 kPa.

Clause 14. The method of clause 7, further comprising:

sampling the ions of the one or more analytes using a mass spectrometer, wherein the ions enter the mass spectrometer, wherein the sample mount is positioned a first distance from the inlet of the mass spectrometer.

Clause 15. The method of clause 7, wherein the mass spectrometer is selected from an ion trap mass spectrometer, a time-of-flight mass spectrometer, a quadrupole mass filter mass spectrometer, an ICR mass spectrometer, a sector mass spectrometer, and a quadrupole time-of-flight hybrid mass spectrometer.

Clause 16. A mass spectrometer system comprising:

an ionization device comprising a piezoelectric cantilever having a precision striker positioned at a first distance to impact a rear side of a metal foil attached to the sample mount; and wherein ions of a sample are produced upon impact of the striker on the metal foil, and the ions pass into the inlet a mass spectrometer having an inlet, wherein the sample mount is positioned a second distance from the inlet.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. In an embodiment, "about 0" can refer to 0, 0.001, 0.01, or 0.1. In an embodiment, the term "about" can include traditional rounding according to significant figures of the numerical value. In addition, the phrase "about 'x' to 'y'" includes "about 'x' to about 'y'".

It should be emphasized that the above-described embodiments of the present disclosure are merely possible examples of implementations, and are set forth only for a clear understanding of the principles of the disclosure. Many variations and modifications may be made to the above-described embodiments of the disclosure without departing substantially from the spirit and principles of the disclosure. All such modifications and variations are intended to be included herein within the scope of this disclosure.

What is claimed is:

1. A mass spectrometer system comprising:

a sample mount configured to hold a sample substrate, wherein the sample substrate has an opposing front side and a back side, wherein a sample is on the front side of the sample substrate;

an ionization device configured to direct a force at the back side of a sample substrate to propagate a shock-wave, wherein the ionization device is at a first distance adjacent the sample mount; and a mass spectrometer having an inlet, wherein the sample mount is positioned a second distance from the inlet.

2. The mass spectrometer system of claim 1, wherein the ionization device comprises:

a pulsed valve having a first gas flow port, wherein the first gas flow port has a closed position and an open position, wherein the first gas flow port has an inlet and an exit, wherein the pulsed valve has a gas inlet in gaseous communication with the inlet of the first gas flow port, wherein when the first gas flow port is in the closed position, the first gas flow port is configured so that gas does not flow through the first gas flow port, wherein when the first gas flow port is in the open position, the first gas flow port is configured so that gas flows through the inlet and out of the exit of the first gas flow port; and the gas exiting the first gas flow port impacts the sample mount having a sample positioned thereon; and wherein ions of the sample are produced upon impact of gas on the sample mount, and the ions pass into the inlet.

3. The mass spectrometer system of claim 2, wherein the pulsed valve is a solenoid valve having an orifice diameter of about 0.25 to about 1 mm.

4. The mass spectrometer system of claim 2, further comprising a pulsing system that is configured to use a pulse to move the first gas flow port from the closed position to the open position, wherein the pulse has a pulse duration of about 250-100 μs.

5. The mass spectrometer system of claim 2, further comprising a gas input system in gaseous communication with the gas inlet of the pulse valve, wherein the gas from the gas input system is discharged at a pressure of about 500 kPa to about 700 kPa.

6. The mass spectrometer system of claim 1, wherein the mass spectrometer is selected from an ion trap mass spectrometer, a time-of-flight mass spectrometer, a quadrupole mass filter mass spectrometer, an ICR mass spectrometer, a sector mass spectrometer, and a quadrupole time-of-flight hybrid mass spectrometer.

7. The mass spectrometer system of claim 1, wherein the ionization device comprises:

a piezoelectric cantilever having a precision striker positioned to impact a rear side of a metal foil attached to the sample mount; and wherein ions of a sample are produced upon impact of the striker on the metal foil, and the ions pass into the inlet.

8. The mass spectrometer system of claim 7, wherein the piezoelectric cantilever is a bimorph piezoelectric cantilever with a frequency of about 300 Hz.

9. The mass spectrometer system of claim 7, wherein the sample mount is placed so that the rear side of the metal foil is about 250 μm from the a tip of the precision striker when the piezoelectric cantilever is in an unactuated position, and front side of the metal foil is about 4 mm from the inlet of the mass spectrometer.

10. A method for mass spectrometer ionization comprising:

directing a force at a back side of a sample substrate, wherein a sample is disposed on a front side of the sample substrate opposite of where the force is directed, wherein the sample includes at least one analyte; and forming ions of one or more of the analytes upon impact of the force on the back side of the sample substrate.

11. The method of claim 10, wherein the force is selected from piezoelectric force or a pulsed gas.

12. The method of claim 11, wherein the force is a piezoelectric force generated by a piezoelectric cantilever, and the sample substrate is disposed on a sample mount adjacent the piezo electric cantilever so that a strike of the piezoelectric cantilever impacts the back side of the sample substrate.

13. The method of claim 12, wherein the piezoelectric cantilever has a frequency of about 200 Hz.

14. The method of claim 10, wherein directing includes:

opening a first gas flow port of a pulsed valve so that gas flows through the first gas flow port toward the back side of the sample substrate.

15. The method of claim 14, wherein the force is a pulsed gas, and the sample substrate is disposed on a sample mount adjacent the exit of the first gas flow port so that the gas exiting the first gas flow port impacts the back side of the sample substrate.

16. The method of claim 14, wherein the pulsed valve is a solenoid valve having an orifice diameter of about 0.25 to about 1 mm, a pulse duration of about 250-100 μs, and wherein the pulse of gas is discharged at a pressure of about 500 kPa to about 700 kPa.

17. The method of claim 10, further comprising:

sampling the ions of the one or more analytes using a mass spectrometer, wherein the ions enter the mass spectrometer, wherein the sample mount is positioned a first distance from the inlet of the mass spectrometer.

18. The method of claim 10, wherein the mass spectrometer is selected from an ion trap mass spectrometer, a time-of-flight mass spectrometer, a quadrupole mass filter mass spectrometer, an ICR mass spectrometer, a sector mass spectrometer, and a quadrupole time-of-flight hybrid mass spectrometer.

* * * * *